US010446022B2

(12) United States Patent
Fowe et al.

(10) Patent No.: US 10,446,022 B2
(45) Date of Patent: Oct. 15, 2019

(54) REVERSIBLE LANE ACTIVE DIRECTION DETECTION BASED ON GNSS PROBE DATA

(71) Applicant: HERE GLOBAL B.V., Eindhoven (NL)

(72) Inventors: James Fowe, Chicago, IL (US); Filippo Pellolio, Chicago, IL (US); Sam Radomy, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 149 days.

(21) Appl. No.: 15/618,482

(22) Filed: Jun. 9, 2017

(65) Prior Publication Data

US 2018/0357890 A1 Dec. 13, 2018

(51) Int. Cl.
*G08G 1/01* (2006.01)
*G08G 1/056* (2006.01)

(52) U.S. Cl.
CPC ..... *G08G 1/0112* (2013.01); *G08G 1/0133* (2013.01); *G08G 1/0141* (2013.01); *G08G 1/056* (2013.01)

(58) Field of Classification Search
CPC .... G08G 1/0112; G08G 1/0141; G08G 1/056; G08G 1/0133

(Continued)

(56) References Cited

U.S. PATENT DOCUMENTS 6,385,539 B1 5/2002 Wilson et al.
6,850,841 B1 2/2005 Casino (Continued)

FOREIGN PATENT DOCUMENTS

EP 1804025 B1 9/2015
WO WO 2012/089282 A1 7/2012

OTHER PUBLICATIONS

Chen, Yihua, et al., "Probabilistic Modeling of Traffic Lanes from GPS Traces", Proceedings of 18th ACM SIGSPATIAL International Conference on Advances in Geographic Information Systems, Nov. 2-5, 2010, 8 pages, San Jose, CA, retrieved from <http://research.microsoft.com/en-us/um/people/jckrumm/Publications %202010/lane_structure_ACM-GIS2010.pdf > on Apr. 6, 2017.

(Continued)

*Primary Examiner* — Isaac G Smith
(74) *Attorney, Agent, or Firm* — Alston & Bird LLP

(57) ABSTRACT

In an example embodiment, a plurality of sequences of instances of probe data are received. Each sequence of instances of probe data is captured and provided by a probe apparatus comprising a plurality of sensors and is onboard a vehicle. An instance of probe data comprises location information indicating a location of the corresponding probe apparatus and the instances are ordered by capture time to form the sequence of instances. A travel direction of each probe apparatus is determined based on the corresponding sequence. Each probe apparatus is matched to a lane of a road segment based on the determined travel direction and a predetermined vehicle lane pattern. The vehicle lane pattern comprises at least one reversible lane. Probe apparatuses matched to the at least one reversible lane are identified. An active direction is determined based on the number of identified probe apparatuses corresponding to each travel direction.

18 Claims, 9 Drawing Sheets

(58) Field of Classification Search
USPC ..... 701/117, 118
See application file for complete search history.

(56) References Cited

U.S. PATENT DOCUMENTS

| | | | | |
|---|---|---|---|---|
| 8,725,404 | B2 | 5/2014 | Kmiecik et al. | |
| 9,500,486 | B2 | 11/2016 | Gale et al. | |
| 9,547,986 | B1 | 1/2017 | Curlander et al. | |
| 2007/0109111 | A1 | 5/2007 | Breed et al. | |
| 2007/0208501 | A1 | 9/2007 | Downs et al. | |
| 2008/0004789 | A1 | 1/2008 | Horvitz et al. | |
| 2009/0138497 | A1 | 5/2009 | Zavoli et al. | |
| 2011/0313648 | A1 | 12/2011 | Newson et al. | |
| 2012/0095682 | A1 | 4/2012 | Wilson | |
| 2013/0282264 | A1 | 10/2013 | Bastiaensen et al. | |
| 2014/0195138 | A1 | 7/2014 | Stelzig et al. | |
| 2014/0278052 | A1 | 9/2014 | Slavin et al. | |
| 2014/0278055 | A1 | 9/2014 | Wang et al. | |
| 2015/0170514 | A1 | 6/2015 | Stenneth | |
| 2015/0262480 | A1* | 9/2015 | Fowe | G01C 21/3492 701/117 |
| 2016/0046290 | A1 | 2/2016 | Aharony et al. | |
| 2016/0091609 | A1 | 3/2016 | Ismail et al. | |
| 2016/0125734 | A1* | 5/2016 | Stenneth | G08G 1/056 340/935 |
| 2016/0167582 | A1 | 6/2016 | Chen et al. | |
| 2016/0171893 | A1 | 6/2016 | Chen et al. | |
| 2017/0365166 | A1 | 12/2017 | Lu et al. | |
| 2018/0113450 | A1 | 4/2018 | Sherony et al. | |
| 2018/0158325 | A1 | 6/2018 | Bernhardt et al. | |

OTHER PUBLICATIONS

Dao, Thanh, et al., "Markov-Based Lane-Positioning Using Inter-Vehicle Communication", IEEE Transaction on Intelligent Transportation Systems, 2007, pp. 641-650, vol. 8, retrieved from <http://citeseerx.ist.psu.edu/viewdoc/download? doi=10.1.1.120.5651&rep=rep1&type=pdf > on Apr. 6, 2017.

Knoop, et al., "Single Frequency Precise Point Positioning. Obtaining a map accurate to lane-level." 16th International IEEE Conference on Intelligent Transportation Systems—(ITSC), 2013; Oct. 6-9, 2013; 7 pages.

U.S. Appl. No. 15/370,311, "Automatic Detection of Lane Closures Using Probe Data", Unpublished (filed Dec. 6, 2016), (Bruce Bernhardt, Inventor) (Here Global B.V., assignee).

Wikipedia Contributors, 'Viterbi algorithm', Wikipedia, The Free Encyclopedia, Nov. 23, 2012 (first revision), retrieved from <https://en.wikipedia.org/wiki/Viterbi_algorithm> on Apr. 6, 2017.

European Patent Office, Extended European Search Report for Application No. 18175444.1, dated Nov. 14, 2018, 9 pages, Germany.

U.S. Patent and Trademark Office, Notice of Allowance for U.S. Appl. No. 15/389,500, 11 pages, U.S.

* cited by examiner

REVERSIBLE LANE ACTIVE DIRECTION DETECTION BASED ON GNSS PROBE DATA

TECHNOLOGICAL FIELD

An example embodiment relates generally to reversible lane traffic information/data corresponding to one or more reversible lanes. An example embodiment relates generally to determining and providing reversible lane traffic information/data that may be used, for example, for performing navigation along road segments having one or more reversible lanes.

BACKGROUND

A reversible lane is a lane in which traffic may travel in either direction, based on certain conditions. Reversible lanes pose a particular challenge for traffic information/data providers and for autonomous driving of vehicles. In particular, identifying probe vehicles traveling along a reversible lane and determining the active direction of a reversible lane is difficult. Generally, the location of a probe vehicle is determined using a global navigation satellite system (GNSS), an example of which is the United States' global positioning system (GPS). Other examples of GNSS systems are GLONASS (Russia), Galileo (European Union) and Beidou/Compass (China), all systems having varying degrees of accuracy. Under good conditions, GPS provides a real-time location of a probe vehicle with a 95% confidence interval of 7.8 meters, according to the US government. Given that the width of many lanes is only 3 to 4 meters, this accuracy is not sufficient to determine the particular lane of a road segment in which a probe vehicle is traveling. Thus, identifying the probe vehicles that are traveling in a reversible lane is difficult based on the noise in the GNSS location information/data. As a result, determining traffic information/data pertaining to a reversible lane and/or performing navigation along a road segment having a reversible lane is difficult.

BRIEF SUMMARY OF EXAMPLE EMBODIMENTS

At least some example embodiments are directed to determining an active direction of one or more reversible lanes based on GNSS location information/data. In an example embodiment, instances of probe information/data may be received, a travel direction of each probe may be determined based on instances of probe information/data, and a distance parameter corresponding to location information/data of each instance of probe information/data may be determined with respect to a reference line corresponding to the road segment and travel direction the probe apparatus is traveling. An instance of probe information/data may then be matched to a most likely lane based on a predetermined vehicle lane pattern and the distance parameter corresponding to the instance of probe data information/data. Sequences of probe information/data that correspond to the same vehicle and/or probe apparatus are identified within the plurality of instances of probe information/data and used to construct probe trajectories. The probe trajectories may then be analyzed based on lane change probabilities to define a lane level trajectory that indicates a lane the vehicle was most likely traveling in when the corresponding instance of probe information/data was generated and/or provided. Thus, the instances of probe information/data of the sequence may be lane level map-matched. The vehicle lane pattern may comprise one or more reversible lanes and, thus, one or more probe apparatuses may be robustly lane level map-matched to the reversible lane(s). Based on the number of probe apparatuses lane level map-matched to the reversible lane that are traveling in a first direction and the number of probe apparatuses lane level map-matched to the reversible lane that are traveling in a second direction, an active direction (e.g., the first direction, the second direction, closed) of the reversible lane(s) is determined. Based on the instances of probe information/data lane level map-matched to the reversible lane(s) and that correspond to probe apparatuses and/or vehicles that are traveling in the active direction, reversible lane traffic information/data may be determined. The reversible lane traffic information/data may then be provided to one more computing entities for use in navigation, informing route determinations, and/or the like.

In an example embodiment, a plurality of sequences of instances of probe data are received. Each sequence of instances of probe data is captured and provided by a probe apparatus of a plurality of probe apparatuses. The probe apparatus comprises a plurality of sensors and is onboard a vehicle. An instance of probe data (i) comprises location information indicating a location of the corresponding probe apparatus and (ii) corresponds to a capture time at which the location information was captured. A sequence of instances of probe data are ordered by the capture time corresponding to each instance of probe data. A travel direction is determined for each probe apparatus of the plurality of probe apparatuses based on the corresponding sequence of instances of probe data. Each probe apparatus is matched to a lane of a road segment based on the determined travel direction and a predetermined vehicle lane pattern. The vehicle lane pattern comprises at least one reversible lane. A first number of probe apparatuses and a second number of probe apparatuses are identified. The first number of probe apparatuses were matched to the reversible lane and have a travel direction of a first direction. The second number of probe apparatuses were matched to the reversible lane and have a travel direction of a second direction. Based on the first number and the second number, an active direction for the at least one reversible lane is determined.

In accordance with an example embodiment, a method is provided that comprises receiving a plurality of sequences of instances of probe data. Each sequence of instances of probe data is captured and provided by a probe apparatus of a plurality of probe apparatuses. The probe apparatus comprises a plurality of sensors and is onboard a vehicle. An instance of probe data (i) comprises location information indicating a location of the corresponding probe apparatus and (ii) corresponds to a capture time at which the location information was captured. A sequence of instances of probe data are ordered by the capture time corresponding to each instance of probe data. In an example embodiment, the method further comprises determining a travel direction of each probe apparatus of the plurality of probe apparatuses based on the corresponding sequence of instances of probe data and matching each probe apparatus to a lane of a road segment based on the determined travel direction and a predetermined vehicle lane pattern. The vehicle lane pattern comprising at least one reversible lane. In an example embodiment, the method further comprises identifying a first number of probe apparatuses and a second number of probe. The first number of probe apparatuses were matched to the reversible lane and have a travel direction of a first direction. The second number of probe apparatuses were matched to the reversible lane and have a travel direction of a second direction. In an example embodiment, the method further comprises determining an active direction for the at least one reversible lane based on the first number and the second number. The active direction is one of the first direction, the second direction, and closed.

In an example embodiment, the method further comprises determining reversible lane traffic data corresponding to traffic conditions currently being experienced on the at least one reversible lane based on the sequences of instances of probe data corresponding to the probe apparatuses matched to the at least one reversible lane in the active direction. In an example embodiment, the method further comprises providing a reversible lane traffic data communication comprising at least a portion of the reversible lane traffic data to a computing entity. When the traffic data communication is processed by the computing entity, the traffic data communication causes the computing entity to (a) perform one or more route planning determinations, (b) provide an alert corresponding to the traffic conditions, or (c) both. In an example embodiment, the method further comprises determining a confidence metric for the active direction based on the number of probe apparatuses matched to the at least one reversible lane for each direction for one or more epochs, wherein an epoch is a time window of a predetermined length. In an example embodiment, the active direction is determined in response to determining that the confidence metric satisfies a threshold requirement.

In an example embodiment, determining an active direction for the at least one reversible lane comprises generating a hidden Markov model based on the first number and the second number for one or more epochs. An epoch is a time window of a predetermined length. In an example embodiment, the method further comprises determining a probability that the active direction of the at least one reversible lane is one of each of a predefined set of states, the predefined set of states comprising: the first direction, the second direction, and closed. In an example embodiment, determining the active direction comprises selecting a state of the predefined set of states having the highest probability. In an example embodiment, a confidence metric is determined for the active direction based at least in part on at least one previous active direction corresponding to at least one of the one or more epochs. In an example embodiment, one or more transition probabilities of the hidden Markov model are time dependent. In an example embodiment, one or more transition probabilities of the hidden Markov model for at least one of the one or more epochs is determined based on a schedule for the at least one reversible lane.

In accordance with an example embodiment, an apparatus is provided that comprises at least one processor, at least one memory storing computer program code, with the at least one memory and the computer program code configured to, with the processor, cause the apparatus to at least receive a plurality of sequences of instances of probe data. Each sequence of instances of probe data is captured and provided by a probe apparatus of a plurality of probe apparatuses. The probe apparatus comprises a plurality of sensors and is onboard a vehicle. An instance of probe data (i) comprises location information indicating a location of the corresponding probe apparatus and (ii) corresponds to a capture time at which the location information was captured. A sequence of instances of probe data are ordered by the capture time corresponding to each instance of probe data. In an example embodiment, the at least one memory and the computer program code are further configured to, with the processor, cause the apparatus to determine a travel direction of each probe apparatus of the plurality of probe apparatuses based on the corresponding sequence of instances of probe data and match each probe apparatus to a lane of a road segment based on the determined travel direction and a predetermined vehicle lane pattern. The vehicle lane pattern comprising at least one reversible lane. In an example embodiment, the at least one memory and the computer program code are further configured to, with the processor, cause the apparatus to identify a first number of probe apparatuses and a second number of probe. The first number of probe apparatuses were matched to the reversible lane and have a travel direction of a first direction. The second number of probe apparatuses were matched to the reversible lane and have a travel direction of a second direction. In an example embodiment, the at least one memory and the computer program code are further configured to, with the processor, cause the apparatus to determine an active direction for the at least one reversible lane based on the first number and the second number. The active direction is one of the first direction, the second direction, and closed.

In an example embodiment, the at least one memory and the computer program code are further configured to, with the processor, cause the apparatus to determine reversible lane traffic data corresponding to traffic conditions currently being experienced on the at least one reversible lane based on the sequences of instances of probe data corresponding to the probe apparatuses matched to the at least one reversible lane in the active direction. In an example embodiment, the at least one memory and the computer program code are further configured to, with the processor, cause the apparatus to provide a reversible lane traffic data communication comprising at least a portion of the reversible lane traffic data to a computing entity. When the traffic data communication is processed by the computing entity, the traffic data communication causes the computing entity to (a) perform one or more route planning determinations, (b) provide an alert corresponding to the traffic conditions, or (c) both. In an example embodiment, the at least one memory and the computer program code are further configured to, with the processor, cause the apparatus to determine a confidence metric for the active direction based on the number of probe apparatuses matched to the at least one reversible lane for each direction for one or more epochs, wherein an epoch is a time window of a predetermined length. In an example embodiment, the active direction is determined in response to determining that the confidence metric satisfies a threshold requirement.

In an example embodiment, determining an active direction for the at least one reversible lane comprises generating a hidden Markov model based on the first number and the second number for one or more epochs. An epoch is a time window of a predetermined length. In an example embodiment, the at least one memory and the computer program code are further configured to, with the processor, cause the apparatus to determine a probability that the active direction of the at least one reversible lane is one of each of a predefined set of states, the predefined set of states comprising: the first direction, the second direction, and closed. In an example embodiment, determining the active direction comprises selecting a state of the predefined set of states having the highest probability. In an example embodiment, a confidence metric is determined for the active direction based at least in part on at least one previous active direction corresponding to at least one of the one or more epochs. In an example embodiment, one or more transition probabilities of the hidden Markov model are time dependent. In an example embodiment, one or more transition probabilities of the hidden Markov model for at least one of the one or more epochs is determined based on a schedule for the at least one reversible lane.

In accordance with an example embodiment, a computer program product is provided that comprises at least one non-transitory computer-readable storage medium having computer-executable program code instructions stored therein with the computer-executable program code instructions comprising program code instructions configured to receive a plurality of sequences of instances of probe data. Each sequence of instances of probe data is captured and provided by a probe apparatus of a plurality of probe apparatuses. The probe apparatus comprises a plurality of sensors and is onboard a vehicle. An instance of probe data (i) comprises location information indicating a location of the corresponding probe apparatus and (ii) corresponds to a capture time at which the location information was captured. A sequence of instances of probe data are ordered by the capture time corresponding to each instance of probe data. In an example embodiment, the computer-executable program code instructions further comprise program code instructions configured to determine a travel direction of each probe apparatus of the plurality of probe apparatuses based on the corresponding sequence of instances of probe data and match each probe apparatus to a lane of a road segment based on the determined travel direction and a predetermined vehicle lane pattern. The vehicle lane pattern comprising at least one reversible lane. In an example embodiment, the computer-executable program code instructions further comprise program code instructions configured to identify a first number of probe apparatuses and a second number of probe. The first number of probe apparatuses were matched to the reversible lane and have a travel direction of a first direction. The second number of probe apparatuses were matched to the reversible lane and have a travel direction of a second direction. In an example embodiment, he computer-executable program code instructions further comprise program code instructions configured to determine an active direction for the at least one reversible lane based on the first number and the second number. The active direction is one of the first direction, the second direction, and closed.

In an example embodiment, the computer-executable program code instructions further comprise program code instructions configured to determine reversible lane traffic data corresponding to traffic conditions currently being experienced on the at least one reversible lane based on the sequences of instances of probe data corresponding to the probe apparatuses matched to the at least one reversible lane in the active direction. In an example embodiment, the computer-executable program code instructions further comprise program code instructions configured to provide a reversible lane traffic data communication comprising at least a portion of the reversible lane traffic data to a computing entity. When the traffic data communication is processed by the computing entity, the traffic data communication causes the computing entity to (a) perform one or more route planning determinations, (b) provide an alert corresponding to the traffic conditions, or (c) both. In an example embodiment, the computer-executable program code instructions further comprise program code instructions configured to determine a confidence metric for the active direction based on the number of probe apparatuses matched to the at least one reversible lane for each direction for one or more epochs, wherein an epoch is a time window of a predetermined length. In an example embodiment, the active direction is determined in response to determining that the confidence metric satisfies a threshold requirement.

In an example embodiment, determining an active direction for the at least one reversible lane comprises generating a hidden Markov model based on the first number and the second number for one or more epochs. An epoch is a time window of a predetermined length. In an example embodiment, the computer-executable program code instructions further comprise program code instructions configured to determine a probability that the active direction of the at least one reversible lane is one of each of a predefined set of states, the predefined set of states comprising: the first direction, the second direction, and closed. In an example embodiment, determining the active direction comprises selecting a state of the predefined set of states having the highest probability. In an example embodiment, a confidence metric is determined for the active direction based at least in part on at least one previous active direction corresponding to at least one of the one or more epochs. In an example embodiment, one or more transition probabilities of the hidden Markov model are time dependent. In an example embodiment, one or more transition probabilities of the hidden Markov model for at least one of the one or more epochs is determined based on a schedule for the at least one reversible lane.

In accordance with yet another example embodiment of the present invention, an apparatus is provided that comprises means for receiving a plurality of sequences of instances of probe data. Each sequence of instances of probe data is captured and provided by a probe apparatus of a plurality of probe apparatuses. The probe apparatus comprises a plurality of sensors and is onboard a vehicle. An instance of probe data (i) comprises location information indicating a location of the corresponding probe apparatus and (ii) corresponds to a capture time at which the location information was captured. A sequence of instances of probe data are ordered by the capture time corresponding to each instance of probe data. In an example embodiment, the apparatus further comprises means for determining a travel direction of each probe apparatus of the plurality of probe apparatuses based on the corresponding sequence of instances of probe data and the apparatus further comprises means for matching each probe apparatus to a lane of a road segment based on the determined travel direction and a predetermined vehicle lane pattern. The vehicle lane pattern comprises at least one reversible lane. In an example embodiment, the apparatus further comprises means for identifying a first number of probe apparatuses and a second number of probe. The first number of probe apparatuses were matched to the reversible lane and have a travel direction of a first direction. The second number of probe apparatuses were matched to the reversible lane and have a travel direction of a second direction. In an example embodiment, the apparatus further comprises means for determining an active direction for the at least one reversible lane based on the first number and the second number. The active direction is one of the first direction, the second direction, and closed.

BRIEF DESCRIPTION OF THE DRAWINGS

Figure 1:
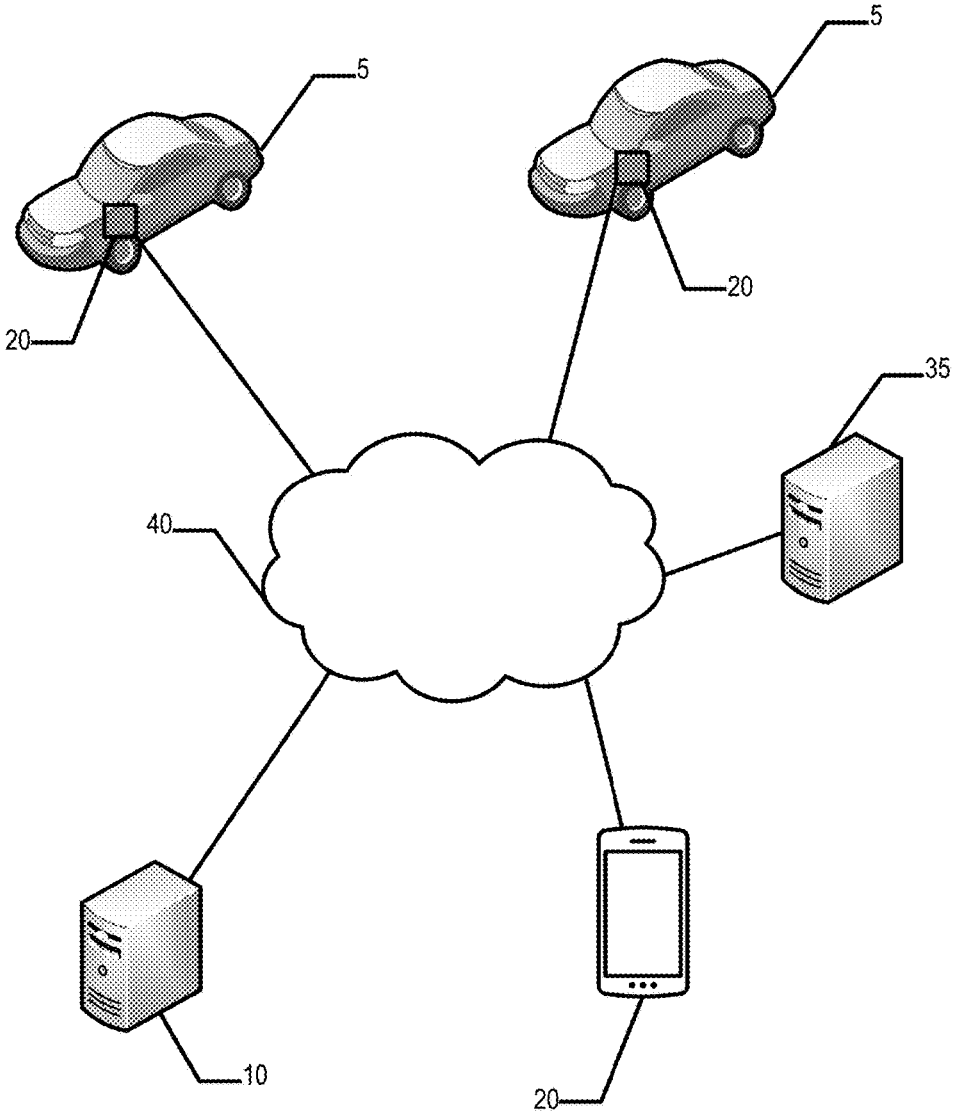
Figure 2A:
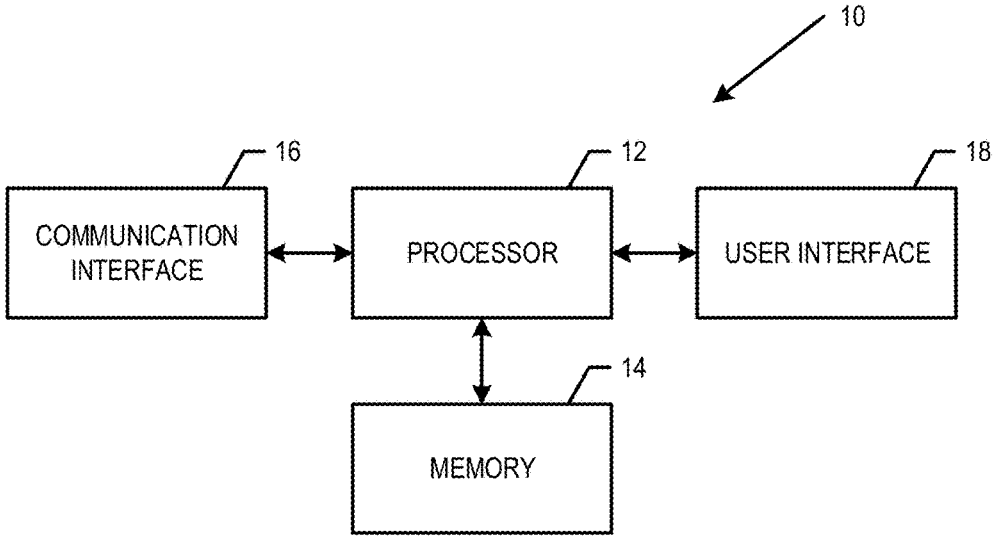
Figure 2B:
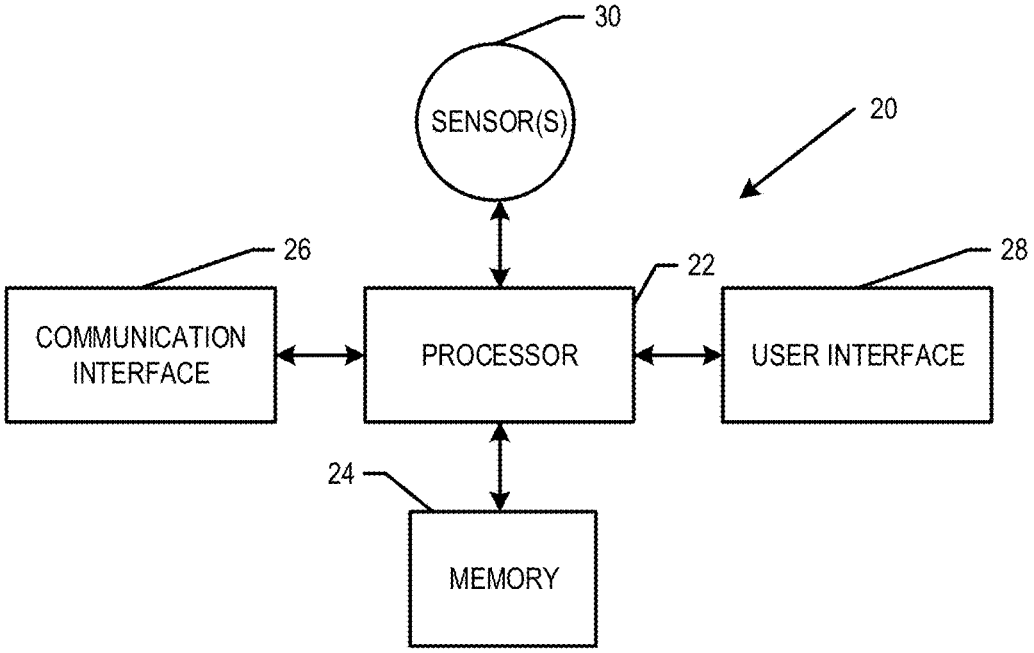
Figure 3:
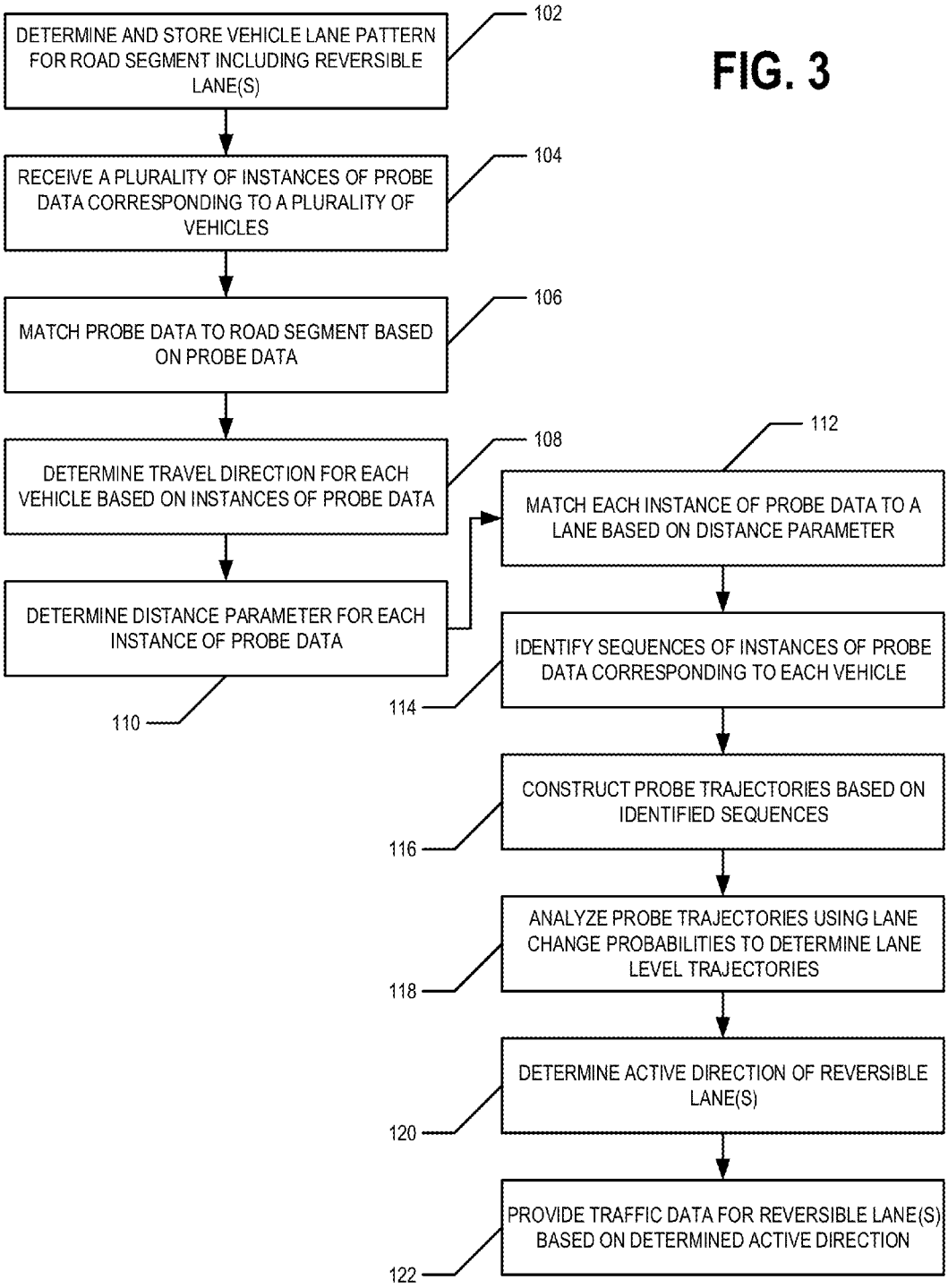
Figure 4:
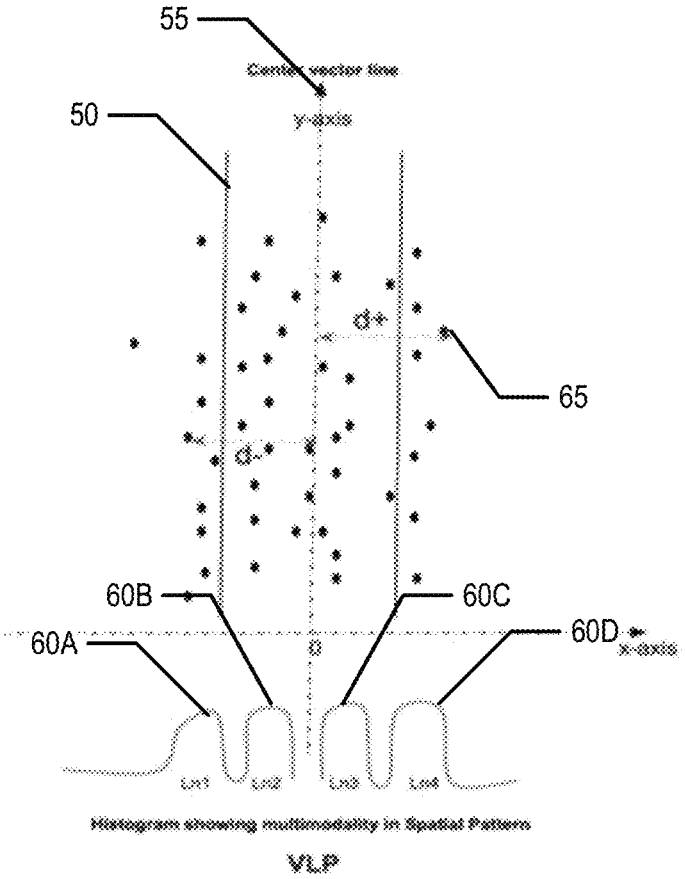
Figure 5:
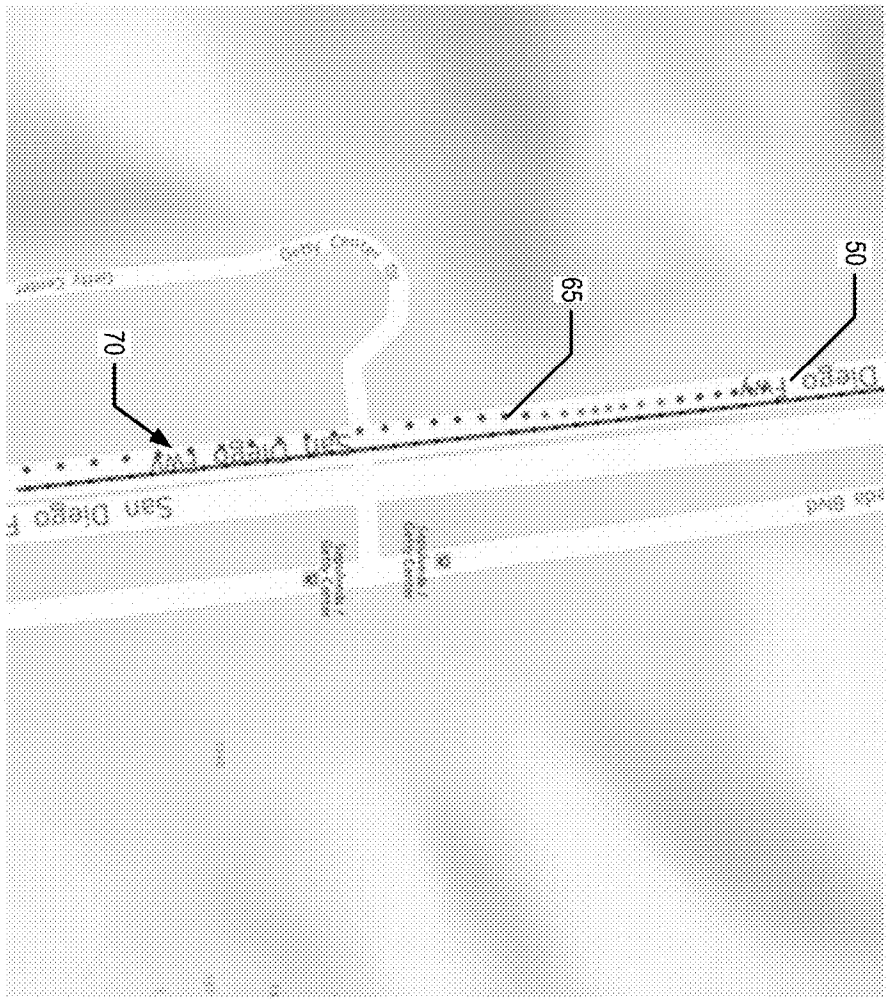
Figure 6:
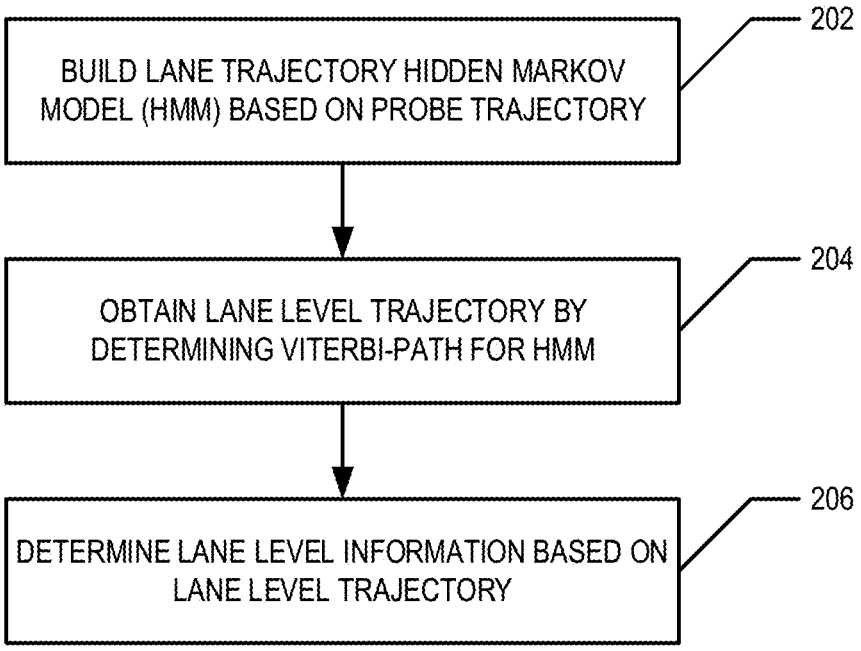
Figure 7:
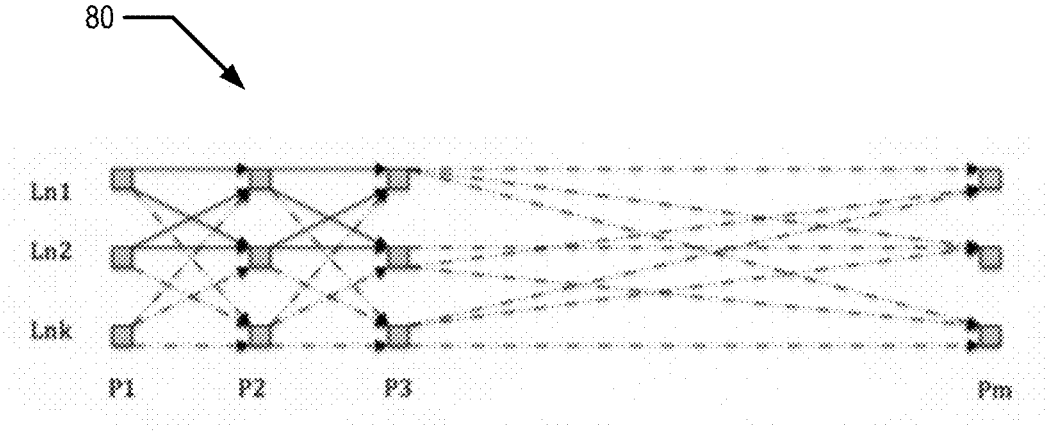
Figure 8:
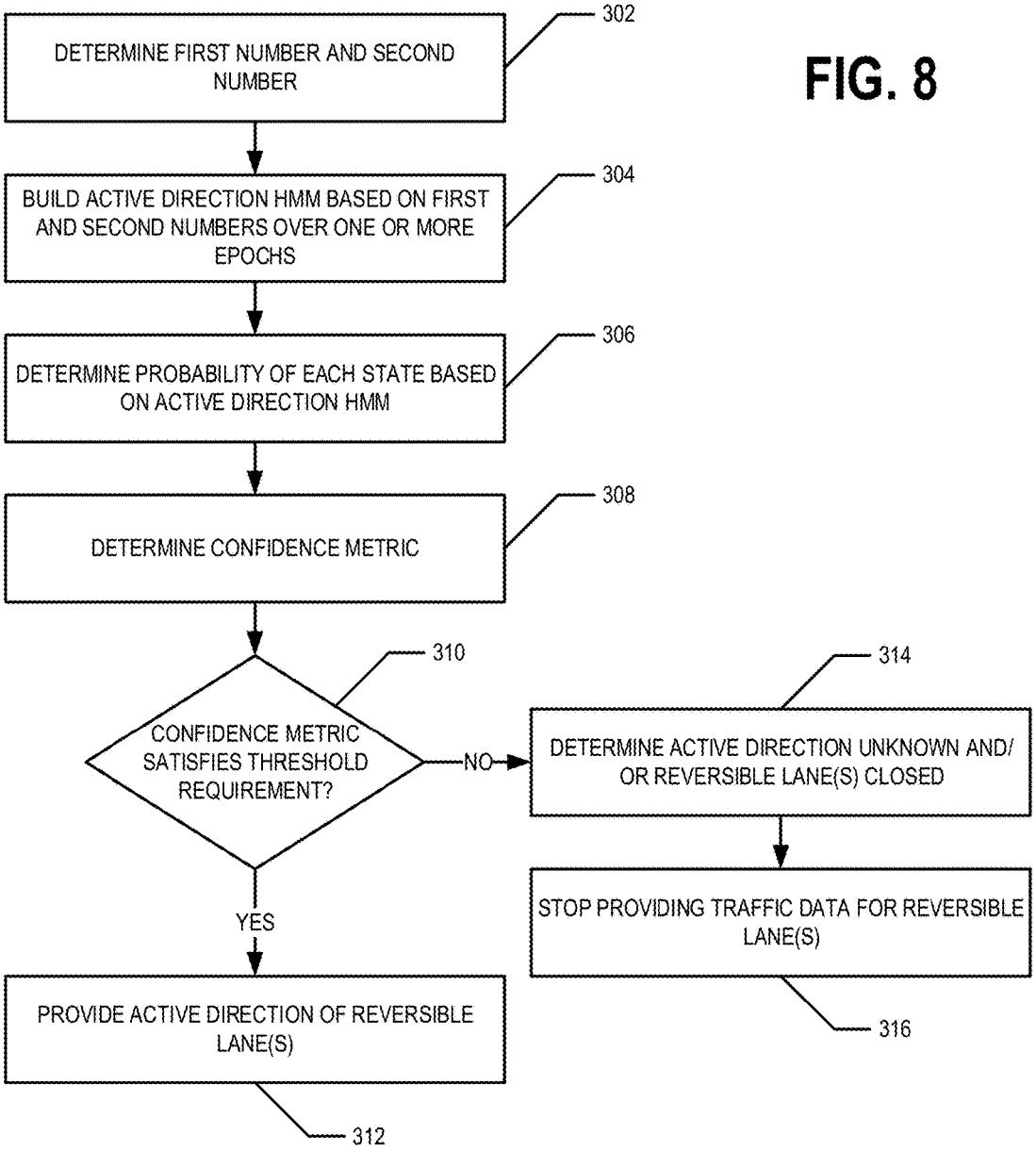
Figure 9:
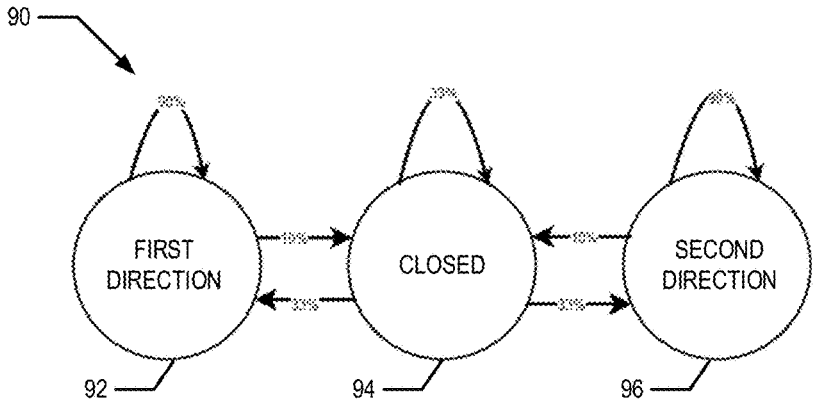
Figure 10:
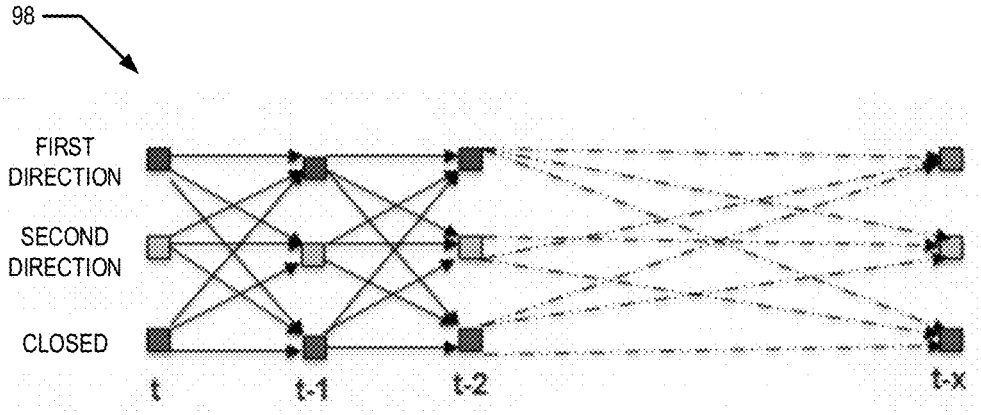

Having thus described certain example embodiments in general terms, reference will hereinafter be made to the accompanying drawings, which are not necessarily drawn to scale, and wherein:

FIG. 1 is a block diagram showing an example architecture of one embodiment of the present invention;

FIG. 2A is a block diagram of an apparatus that may be specifically configured in accordance with an example embodiment;

FIG. 2B is a block diagram of a probe apparatus that may be specifically configured in accordance with an example embodiment;

FIG. 3 is a flowchart illustrating operations performed, such as by the apparatus of FIG. 2A to provide reversible lane traffic information/data, in accordance with an example embodiment;

FIG. 4 is a diagram of an example method of determining a vehicle lane pattern for a road segment, in accordance with an example embodiment;

FIG. 5 illustrates an example lane level trajectory, in accordance with an example embodiment;

FIG. 6 is a flowchart illustrating operations performed, such as by the apparatus of FIG. 2A to analyze a probe trajectory to determine a lane level trajectory, in accordance with an example embodiment;

FIG. 7 is an example trellis diagram of a model that may be generated to analyze a probe trajectory, in accordance with an example embodiment;

FIG. 8 is a flowchart illustrating operations performed, such as by the apparatus of FIG. 2A to determine an active direction of a reversible lane, in accordance with an example embodiment;

FIG. 9 is an example Markov graph of a model that may be generated to determine an active direction of a reversible lane, in accordance with an example embodiment; and FIG. 10 is an example trellis diagram of a model that may be generated to determine an active direction of a reversible lane, in accordance with an example embodiment.

DETAILED DESCRIPTION OF SOME EXAMPLE EMBODIMENTS

Some embodiments will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

I. General Overview

For example, the I-90 Bridge in Seattle, Wash. comprises a total of eight lanes. Three lanes are dedicated to travel a first direction, three lanes are dedicated to travel in a second direction, and two lanes are reversible between the first direction and the second direction. As used herein, a reversible lane is a lane in which traffic may travel in either direction, depending on certain conditions. For example, a reversible lane is not dedicated to travel in a particular direction. For example, at any point in time a reversible lane is in one of a predefined set of states. The set of predefined states may comprise and/or consist of open for travel in a first direction, open for travel in a second direction, and closed. Continuing with the above example, to allow for efficient navigation across the I-90 Bridge in Seattle by an autonomously driven vehicle, it would be helpful for the active direction and/or current traffic conditions (e.g., the reversible lane traffic information/data) of the reversible lanes to be known. As noted above, the GNSS location information/data comprises too much noise for merely map matching the GNSS location information/data to road segment corresponding to the reversible lanes to provide a robust determination of the active direction and/or reversible lane traffic information/data. Methods, apparatus, and computer program products are provided herein in accordance with an example embodiment in order to determine an active direction for one or more reversible lanes and determine reversible lane traffic information/data for the one or more reversible lanes. For example, the reversible lane traffic information/data may be used to perform lane level navigation, route planning, and/or the like.

In an example embodiment, a plurality of sequences of instances of probe information/data may be received from probe apparatuses traveling along a road segment onboard vehicles. The road segment may comprise one or more reversible lanes and/or have one or more reversible lanes corresponding thereto. According to various embodiments, an instance of probe information/data may comprise location information/data. For example, the probe information/data may comprise a geophysical location (e.g., latitude and longitude) indicating the location of the probe apparatus at the time that the probe information/data is generated and/or provided (e.g., transmitted). In an example embodiment, an instance of probe information/data may correspond to a capture time such that a plurality (e.g., two or more) instances of probe information/data captured by a probe apparatus may be ordered based on the capture time corresponding to each of the instances of probe information/data. In an example embodiment, an instance of probe information/data comprises a capture time timestamp for that instance of probe information/data. In an example embodiment, an instance of probe information/data may comprise a probe identifier identifying the probe apparatus that generated and/or provided the probe information/data, a capture time timestamp corresponding to the (absolute or relative) time when the probe information/data was generated, and/or the like. Based on the probe identifier and the capture time timestamp a sequence of instances of probe information/data may be identified. For example, the instances of probe information of data corresponding to a sequence of instances of probe information/data may each comprise the same probe identifier. In an example embodiment, the instances of probe information/data in a sequence of instances of probe information/data are ordered based on the capture time timestamps associated therewith. By analyzing a sequence of probe information/data indicating a vehicle traveling along a road segment in light of a vehicle lane pattern for the road segment, a lane level trajectory for the vehicle along at least a portion of the road segment may be determined. The vehicle may then be matched to a particular lane of the road segment based on the determined lane level trajectory for the vehicle.

In an example embodiment, the vehicle lane pattern may correspond to a travel direction along the road segment (e.g., the first direction or the second direction). In an example embodiment, the vehicle lane pattern corresponding to the first direction along the road segment and the vehicle lane pattern corresponding to the second direction along the road segment may both comprise lanes corresponding to the reversible lanes. The lane level trajectory of a plurality of vehicles may be analyzed to identify vehicles traveling in the reversible lanes. Due to the noise the in GNSS location information/data, one or more vehicles traveling in a direction that is not the active direction of the one or more reversible lanes may be erroneously matched to one of the reversible lanes. Thus, the relative number of vehicles matched to the reversible lanes and traveling in the first direction may be determined and the relative number of vehicles matched to the reversible lanes and traveling in the second direction may be determined. Based on the number of vehicles matched to the reversible lanes and traveling in the first direction and the number of vehicles matched to the reversible lanes and travelling in the second direction, the active direction of the reversible lanes may be determined.

FIG. 1 provides an illustration of an example system that can be used in conjunction with various embodiments of the present invention. As shown in FIG. 1, the system may include a plurality of probe apparatuses 20, one or more apparatuses 10, one or more other computing entities 35, one or more networks 40, and/or the like. In various embodiments, the probe apparatus 20 may be an in vehicle navigation system, vehicle control system, a mobile computing device, and/or the like. For example, a probe apparatus 20 may be an in vehicle navigation system mounted within and/or be on-board a vehicle 5 such as a motor vehicle, non-motor vehicle, automobile, car, scooter, truck, van, bus, motorcycle, bicycle, Segway, golf cart, and/or the like. In various embodiments, the probe apparatus 20 may be a smartphone, tablet, personal digital assistant (PDA), and/or other mobile computing device. In another example, the probe apparatus 20 may be a vehicle control system configured to autonomously drive a vehicle 5, assist in control of a vehicle 5, and/or the like. In example embodiments, a probe apparatus 20 is onboard a dedicated probe vehicle. In some embodiments, a probe apparatus 20 may be onboard a personal vehicle, commercial vehicle, public transportation vehicle, and/or other vehicle. In an example embodiment, a probe apparatus 20 is any apparatus that provides (e.g., transmits) probe information/data to the apparatus 10.

In an example embodiment, an apparatus 10 may comprise components similar to those shown in the example apparatus 10 diagrammed in FIG. 2A. In an example embodiment, the apparatus 10 is configured to provide map updates, traffic information/data, and/or the like to the probe apparatus 20 and/or computing entity 35. In an example embodiment, the apparatus 10 may be a server or other computing device. In an example embodiment, a probe apparatus 20 may comprise components similar to those shown in the example probe apparatus 20 diagrammed in FIG. 2B. In various embodiments, the apparatus 10 may be located remotely from the probe apparatus 20. Each of the components of the system may be in electronic communication with, for example, one another over the same or different wireless or wired networks 40 including, for example, a wired or wireless Personal Area Network (PAN), Local Area Network (LAN), Metropolitan Area Network (MAN), Wide Area Network (WAN), cellular network, and/or the like. In some embodiments, a network 40 may comprise the automotive cloud, digital transportation infrastructure (DTI), radio data system (RDS)/high definition (HD) radio or other digital radio system, and/or the like. For example, a probe apparatus 20 may be in communication with an apparatus 10 via the network 40. For example, the probe apparatus 20 may communicate with the apparatus 10 via a network, such as the Cloud. For example, the Cloud may be a computer network that provides shared computer processing resources and data to computers and other devices connected thereto. For example, the probe apparatus 20 may be configured to receive one or more map tiles of a digital map from the apparatus 10, traffic information/data (embedded in a map tile of a digital map or separate therefrom), and/or provide probe information/data to the apparatus 10.

In an example embodiment, as shown in FIG. 2B, the probe apparatus 20 may comprise a processor 22, memory 24, a communications interface 26, a user interface 28, one or more sensors 30 (e.g., a location sensor such as a GNSS sensor; IMU sensors; camera(s); two dimensional (2D) and/or three dimensional (3D) light detection and ranging (LiDAR)(s); long, medium, and/or short range radio detection and ranging (RADAR); ultrasonic sensors; electromagnetic sensors; (near-) infrared (IR) cameras; 3D cameras; 360° cameras; and/or other sensors that enable the probe apparatus 20 to determine one or more features of the corresponding vehicle's 5 surroundings), and/or other components configured to perform various operations, procedures, functions or the like described herein. In at least some example embodiments, the memory 24 is non-transitory.

Similarly, as shown in FIG. 2A, the apparatus 10 may comprise a processor 12, memory 14, a user interface 18, a communications interface 16, and/or other components configured to perform various operations, procedures, functions or the like described herein. In at least some example embodiments, the memory 14 is non-transitory. The computing entity 35 may comprise similar elements to the apparatus 10 and/or the probe apparatus 20. For example, the computing entity 35 may comprise a processor, memory, a user interface, a communications interface, and/or the like. In example embodiments, the computing entity 35 may comprise one or more sensors similar to sensor(s) 30. Certain example embodiments of the probe apparatus 20 and the apparatus 10 are described in more detail below with respect to FIGS. 2A and 2B.

II. Example Operation

In at least some example embodiments, probe information/data may be analyzed to determine an active direction of one or more reversible lanes. In an example embodiment, the probe information/data may be used to determine reversible lane traffic information/data based on the determined active direction of the one or more reversible lanes. In an example embodiment, the reversible lane traffic information/data may be used to perform various lane level navigation determinations, calculations, computations, and/or the like. For example, a probe apparatus 20 may determine if one or more reversible lanes are available for use by the corresponding vehicle 5 and/or if it would be advantageous for the vehicle 5 to use one or more reversible lanes based on the reversible lane traffic information/data.

For example, a vehicle lane pattern may be established for a road segment and/or a link of a digital map corresponding to the road segment. In example embodiments, a vehicle lane pattern may comprise information regarding the number of lanes along the road segment, a lane identifier for each lane of the road segment, a representative distance parameter (e.g., mean, mode, median, average, and/or the like) for the road segment, a distribution description describing the distribution of distance parameters of vehicles traveling in the lane (e.g., a standard deviation of distance parameters of vehicles traveling in the lane, and/or the like), a width of the lane, a representative speed for the lane (e.g., mean, mode, median, average, free flow, and/or the like), a distribution description describing the distribution of speeds (e.g., standard deviation and/or the like), a day and/or time period for which the vehicle lane pattern is relevant, and/or the like. In an example embodiment, the vehicle lane pattern is established based on historical probe information/data. For example, the vehicle lane pattern may be established based on one, two, three, four, five, six, seven, and/or the like days of historical probe information/data. In an example embodiment, the vehicle lane period may correspond to a particular day (or days) and time. For example, a vehicle lane pattern may correspond to and/or be relevant to traffic on Monday, Tuesday, Wednesday, and Thursdays from 5 to 5:30 pm. In another example, a vehicle lane pattern may correspond and/or be relevant to traffic on Saturdays from 1 to 3 pm. For example, if a road segment comprises a reversible lane, a shoulder lane, and/or the like that is only in use during a particular time period and/or on particular days, a vehicle lane pattern corresponding to road segment may be relevant to a particular day of the week and/or time of day. In example embodiments, a distance parameter may indicate the distance from a reference line of the road segment to position on a road segment indicated by the location information/data provided by an instance of probe information/data. Additional information/data regarding the distance parameter and determination thereof is provided elsewhere herein. Generally, as described herein the vehicle lane pattern, is pre-determined using historical probe information/data. The vehicle lane pattern may then be stored (e.g., in memory 14) in association with a link identifier configured to identify a digital map link corresponding to the road segment. In an example embodiment, the vehicle lane pattern may be determined in real-time or near real-time using, for example, real-time and/or near real-time probe information/data.

In an example embodiment, if a road segment has one or more reversible lanes corresponding thereto, a vehicle lane pattern may be determined for each travel direction of the road segment. In an example embodiment, the vehicle lane patterns for the road segment in both directions include lanes corresponding to the one or more reversible lanes. For example, a first vehicle lane pattern may correspond to the lanes dedicated to traffic traveling in the first direction and the reversible lane(s). Similarly, a second vehicle lane pattern may correspond to lanes dedicated to traffic traveling in the second direction and the reversible lane(s).

After the vehicle lane pattern is determined and/or stored (e.g., in memory 14), a plurality of instances of probe information/data are received. In an example embodiment, a probe apparatus 20 may provide (e.g., transmit) probe information/data to an apparatus 10. The probe information/data may comprise at least one of a probe identifier configured to identify the probe apparatus 20, a link identifier configured to identify the digital map link representing the road segment the probe apparatus 20 is travelling along, location information/data indicating a geophysical location of the probe apparatus 20 (e.g., determined by a location sensor 30), a travel speed of the probe apparatus 20 and/or the corresponding vehicle 5 travelling along at least a portion of the road segment, a capture time timestamp, and/or the like. In example embodiments, the travel speed may be an instantaneous travel speed, an average travel speed over a short time interval (e.g., 10 seconds, 30 seconds, one minute, and/or the like), an average speed over a short distance interval (e.g., along the length of road segment, along a portion of the pre-intersection road segment, and/or the like). In example embodiments, the travel speed may be determined by one or more sensors 30 (e.g., GNSS, IMU, and/or the like), by the vehicle's 5 speedometer, and/or the like. In an example embodiment, the travel speed of a probe apparatus 20 and/or the corresponding vehicle 5 may be determined based on distance traveled and the time elapsed between the location information/data corresponding to two or more instances probe information/data.

In an example embodiment, the probe information/data is analyzed in time bins or epochs. For example, an epoch may be a time window or time period of a predetermined or configurable length. For example, the instances of probe information/data received during a one minute, five minute, ten minute, and/or other configurable time period may be binned together and/or analyzed together to determine an active direction and/or reversible lane traffic information/data corresponding to the configurable time period. In particular, the time bins or epochs may be short enough that traffic conditions are generally similar across the predetermined or configurable time period.

In an example embodiment, a plurality of instances of probe information/data (within a time bin or epoch) may be analyzed to identify sequences of probe information/data (e.g., based on the corresponding probe identifier) and determine a lane level trajectory for the sequence of probe information/data. A plurality of lane level trajectories may be determined based on a plurality of sequences of probe information/data. The plurality of lane level trajectories may then be used to match a probe apparatus 20 and/or corresponding vehicle 5 to a lane. For example, based on the corresponding lane level trajectory, a probe apparatus 20 and/or corresponding vehicle 5 may be matched to a lane of the vehicle lane pattern that corresponds to a reversible lane. A first number of probe apparatuses 20 and/or corresponding vehicles 5 traveling along the road segment in the first direction that were matched to reversible lanes may be identified and/or determined. Similarly, a second number of probe apparatuses 20 and/or corresponding vehicles 5 traveling along the road segment in the second direction that were matched to reversible lanes may be identified and/or determined. The first number and second number may then be used to determine an active direction of the reversible lanes.

After determining the active direction, and/or in response thereto, reversible lane traffic information/data may be determined based on the probe information/data corresponding to probe apparatuses 20 and/or vehicles 5 matched to the one or more reversible lanes and that are traveling along the road segment in the active direction. For example, if it is determined that the active direction is the first direction, the probe information/data, lane level trajectories, and/or the like corresponding to probe apparatuses 20 and/or corresponding vehicles 5 that were matched to the one or more reversible lanes and that are traveling along the road segment in the first direction may be used to determine the reversible lane traffic information/data. In an example embodiment, reversible lane traffic information/data may comprise an average travel speed, traffic volume, reversible lane specific alerts, and/or the like for the one or more reversible lanes of a road segment. In an example embodiment, reversible lane traffic information/data may comprise information/data indicating the current lane a particular vehicle 5 is traveling in. For example, the reversible lane traffic information/data provided to a particular probe apparatus 20 and/or computing entity 35, may comprise information/data indicating that the vehicle 5 corresponding to the particular probe apparatus 20 and/or computing entity 35 is traveling or is not traveling in one of the one or more reversible lanes. The particular probe apparatus 20 and/or computing entity 35 may then use the lane determination for the vehicle 5 to perform one or more lane level navigation determinations, calculations, computations, and/or the like.

In an example embodiment, a distance parameter for each instance of the plurality of instances of probe information/data may be determined. For example, the distance parameter d may be determined by determining the distance between (a) the location indicated by the location information/data of an instance of probe information/data and (b) a reference line of a road segment. In an example embodiment, the reference line of a road segment may be a center line of the road segment, a right hand edge of the road segment, a left hand edge of the road segment, and/or another reference line of the road segment. In an example embodiment, the distance parameter d may indicate a relative position of the location information/data relative to the road segment and/or the reference line.

In an example embodiment, each instance of probe information/data may then be matched to a lane based on the distance parameter d determined for that probe information/data. For example, if a distance parameter d for a first instance of probe information/data is determined to be 2.3 meters and the vehicle lane pattern for the corresponding road segment has two lanes with the representative distance parameters of 2.0 meters for Lane 1 and 4.5 meters for Lane 2, the first instance of probe information/data may be matched to Lane 1. In an example embodiment, the probability of the vehicle 5 having the distance parameter d being in each lane is determined. For example, the probability that distance parameter d for the first instance of probe information/data corresponds to the corresponding vehicle 5 traveling in Lane 1 may be 85% and the probability that the distance parameter d for the first instance of probe information/data corresponds to the corresponding vehicle 5 traveling in Lane 2 may be 10%. In an example embodiment, the probability that a distance parameter d corresponds to a particular lane may be determined based on the representative distance parameter for the lane and the distribution description for the lane. In another example embodiment, a normalized probability of the vehicle 5 having the distance parameter d being in each lane is determined. For example, the normalized probability that distance parameter d for the first instance of probe information/data corresponds to the corresponding vehicle 5 traveling in Lane 1 may be 89% and the normalized probability that the distance parameter d for the first instance of probe information/data corresponds to the corresponding vehicle 5 traveling in Lane 2 may be 11%. As should be understood, the sum of the normalized probabilities is 100%.

In an example embodiment, a one or more sequences of instances of probe information/data may be identified. In an example embodiment, a sequence of instances of probe information/data may consist of probe information/data that comprises the same probe identifier. For example a sequence of instances probe information/data may be identified based on matching instances of probe information/data comprising the same probe identifier. In an example embodiment, the sequence of instances of probe information/data may be ordered based on the capture time timestamp associated with each instance of probe information/data. Thus, for a first probe identifier, it may be determined that at time $t_1$ an instance of probe information/data corresponding to the first probe identifier was matched to Lane 1, at time $t_2$ an instance of probe information/data corresponding to the first probe identifier was matched to Lane 1, and at time $t_3$ an instance of probe information/data corresponding to the first probe identifier was matched to Lane 2. Thus, a probe trajectory corresponding to a particular probe apparatus 20 and/or vehicle 5 may be generated and/or determined based on the corresponding sequence of instances of probe information/data that has been matched to lanes of the road segment. In example embodiments, a probe trajectory may correspond to three or more instances of probe information/data.

As previously noted, the accuracy of various GNSS systems may not be sufficient to locate a particular vehicle 5 to a particular lane. For example, the noise within a GNSS reading may cause consecutive instances of probe information/data in a sequence of instances of probe information/data to be matched to different lanes, even if the vehicle 5 travels in the same lane throughout the sequence. For example, a sequence of five instances of probe information/data may lead to a probe trajectory of Lane 1, Lane 2, Lane, 1, Lane 2, Lane 1. However, if the time or distance between the capturing of the instances of probe information/data is short (e.g., a few seconds, a few meters and/or the like), it is unlikely that the vehicle 5 is continuously changing lanes. Therefore, the probe trajectory may be analyzed based at least in part on the probability of a lane change during the time/distance between consecutive instances of probe information/data to determine a lane level trajectory corresponding to the vehicle 5. In an example embodiment, the probability of a lane change during the time/distance between consecutive instances of probe information/data may be determined based on historical probe information/data, apriori information/data, and/or the like. In an example embodiment, the probability of a lane change during a short time/distance interval between consecutive instances of probe information/data may be smaller than the probability of a lane change during a long time/distance interval between consecutive instances of probe information/data.

The lane level trajectory corresponding to one or more sequences of instances of probe information/data may be determined. For example, the lane level trajectory corresponding to one or more vehicles 5 may be determined. Based on the one or more lane level trajectories, one or more vehicles 5 may be matched to the one or more reversible lanes. Based on the number of vehicles 5 matched to the reversible lanes traveling in first direction (e.g., the first number) and the number of vehicles 5 matched to the reversible lanes traveling in the second direction (e.g., the second number), the active direction of the reversible lanes may be determined. The one or more lane level trajectories and/or probe information/data corresponding to the probe apparatuses 20 and/or vehicles 5 matched to the reversible lanes and traveling in the active direction of the reversible lanes may be used to determine, generate, and/or the like reversible lane traffic information/data. For example, travel speed, volume, and/or the like may be determined for one or more reversible lanes of the road segment based on the determined lane level trajectories and/or the corresponding probe information/data. The reversible lane traffic information/data may then be provided to one or more computing entities 35, stored for later use (e.g., in memory 14), and/or the like.

After and/or responsive to determining, and/or the like active direction of the one or more reversible lanes and/or the reversible lane traffic information/data for the road segment, a reversible lane traffic information/data communication may be provided to one or more computing entities 35. In an example embodiment, the reversible lane traffic information/data communication may indicate the active direction of the one or more reversible lanes and/or comprise at least a portion of the determined reversible lane traffic information/data. In an example embodiment, the reversible lane traffic information/data communication comprises an updated map tile, a traffic information/data map tile layer, and/or the like. For example, a computing entity 35 may be a probe apparatus 20 (e.g., corresponding to a vehicle 5 that is approaching the road segment, expected to travel along the road segment on a current trip or an expected trip, currently travelling along the road segment, and/or the like) or a traffic management apparatus. For example, the computing entity 35 may be a traffic management apparatus that is operated by and/or on behalf of a traffic management agency (e.g., a local department of transportation, city traffic management office, and/or the like). In example embodiments, the lane level traffic information/data may comprise computer-executable code and/or reference computer-executable code that, when executed by the computing entity 35 may cause the computing entity 35 to provide one or more reversible lane alerts through a user interface thereof (e.g., a display, audible alert, and/or the like). For example, the location information/data may be used to identify a position (e.g., latitude and longitude) along a link of a digital map representing a road segment the probe apparatus 20 and/or vehicle 5 is travelling along. The link may be defined by a line in latitude and longitude space. In an example embodiment, the computing entity 35 may, responsive to receiving the reversible lane traffic information/data communication and/or in response to executing the computer-executable code therein and/or referenced thereby, perform one or more navigation tasks based on the reversible lane traffic information/data. For example, one or more route planning computations, determinations, and/or the like may be performed that take into account the reversible lane traffic information/data and provide directions and/or determinations for the route. For example, a route planning computation, determination, and/or the like may comprise recalculating a route, determining an updated travel and/or expected arrival time, determining if a vehicle 5 should travel along a reversible lane, and/or the like.

Determining Reversible Lane Traffic Information/Data

FIG. 3 provides a flowchart illustrating processes and procedures that may be completed, for example by an apparatus 10, to determine and/or provide an active direction for one or more reversible lanes and/or reversible lane traffic information/data. In an example embodiment, the reversible lane active direction and/or reversible lane traffic information/data may be used to perform lane level navigation and/or navigation along a road segment comprising a reversible lane. For example, the reversible lane active direction and/or reversible lane traffic information/data may be used to determine if a driver should be directed to use the reversible lane(s) and/or to determine if an autonomously driven vehicle should use the reversible lane(s). In an example embodiment, the reversible lane traffic information/data may comprise a reversible lane specific representative travel speed (e.g., an average travel speed) for one or more reversible lanes of the road segment, a lane specific distribution description (e.g., standard deviation) of travel speed, a lane specific traffic volume measurement, lane specific alerts, lane specific traffic jam information/data, and/or the like for one or more reversible lanes of the road segment. In an example embodiment, the reversible lane traffic information/data may comprise one reversible lane representative travel speed, distribution description of travel speed, traffic volume measurement, and/or the like for the one or more reversible lanes. In other words, in example embodiments, the reversible lane traffic information/data may be broken down into information/data corresponding to individual reversible lanes or composite reversible lane traffic information/data may be provided that corresponds to two or more reversible lanes and is not specific to an individual reversible lane. In an example embodiment, the reversible lane traffic information/data may comprise information/data indicating the current lane a particular vehicle 5 is traveling in (e.g., as of the last instance of probe information/data provided by the probe apparatus 20 onboard the particular vehicle 5) and/or whether the particular vehicle 5 is traveling or not traveling in a reversible lane. In an example embodiment, the reversible lane traffic information/data may be determined in real-time or near real-time. In one example embodiment, reversible lane traffic information/data may be determined using historical probe information/data.

Starting at block 102, a vehicle lane pattern for a road segment is determined. For example, the apparatus 10 may determine a vehicle lane pattern for the road segment. For example, the apparatus 10 may comprise means, such as the processor 12 and/or the like, for determining a vehicle lane pattern for the road segment. In an example embodiment, the vehicle lane pattern may be determined based on historical probe information/data. For example, the vehicle lane pattern may be determined based on one to four days, a week, and/or the like of historical probe information/data. In example embodiments, a vehicle lane pattern may comprise information regarding the number of lanes along the road segment, a lane identifier for each lane of the road segment, a representative distance parameter (e.g., mean, mode, median, average, and/or the like) for each lane of the road segment, a distribution description describing the distribution of distance parameters of vehicles traveling in the lane (e.g., a standard deviation of distance parameters of vehicles traveling in the lane, and/or the like), a width of the lane, a representative speed for the lane (e.g., mean, mode, median, average, free flow, and/or the like), a distribution description describing the distribution of speeds (e.g., standard deviation and/or the like), a day and/or time period for which the vehicle lane pattern is relevant, and/or the like. In an example embodiment, the vehicle lane pattern is established based on historical probe information/data. For example, the vehicle lane pattern may be established based on one, two, three, four, five, six, seven and/or the like days of historical probe information/data. In an example embodiment, the vehicle lane period may correspond to a particular day (or days) and time. For example, a vehicle lane pattern may correspond to and/or be relevant to traffic on Monday, Tuesday, Wednesday, and Thursdays from 5 to 5:30 pm. In another example, a vehicle lane pattern may correspond and/or be relevant to traffic on Saturdays from 1 to 3 pm. For example, if a road segment comprises a reversible lane, a shoulder lane, and/or the like that is only in use during a particular time period and/or on particular days, a vehicle lane pattern corresponding to road segment may be relevant to a particular day of the week and/or time of day. In example embodiments, a distance parameter may indicate the distance from a reference line of the road segment to position on a road segment indicated by the location information/data provided by an instance of probe information/data. Additional information/data regarding the distance parameter and determination thereof is provided elsewhere herein. Generally, as described herein the vehicle lane pattern, is pre-determined using historical probe information/data. In an example embodiment, the vehicle lane pattern may be determined in real-time or near real-time using, for example, real-time and/or near real-time probe information/data.

In an example embodiment, if a road segment has one or more reversible lanes corresponding thereto, a vehicle lane pattern may be determined for each travel direction of the road segment. In an example embodiment, the vehicle lane patterns for the road segment in both directions include lanes corresponding to the one or more reversible lanes. For example, a first vehicle lane pattern may correspond to the lanes dedicated to traffic traveling in the first direction and the reversible lane(s). Similarly, a second vehicle lane pattern may correspond to lanes dedicated to traffic traveling in the second direction and the reversible lane(s).

In an example embodiment, the vehicle lane pattern may be determined using a clustering technique. For example, a vehicle lane pattern may be determined using a technique similar to that described in co-pending U.S. application Ser. No. 15/370,311, filed Dec. 6, 2016, which is hereby incorporated in its entirety by reference. In an example embodiment, a k-means clustering technique may be used to cluster instances of probe information/data based on the corresponding distance parameters. As should be understood, various clustering techniques may be used in various embodiments to cluster instances of probe information/data based on the corresponding distance parameter to determine a vehicle lane pattern for a road segment. FIG. 4 illustrates a plurality of locations 65 along a road segment 50 that each correspond to an instance of probe information/data. A distance parameter d may indicate the distance from a reference line 55 of the road segment. By clustering the instance of probe information/data based on the distance parameters d, the clusters 60A, 60B, 60C, and 60D are identified and/or determined. Clusters 60A, 60B, 60C, and 60D each correspond to a lane of traffic along the road segment 50. Once a vehicle lane pattern is determined, the vehicle lane pattern may be stored (e.g., by memory 14) for later use.

Returning to FIG. 3, at block 104, a plurality of sequences of instances of probe information/data are received. For example, after the vehicle lane pattern is determined and/or stored, a plurality of sequences of instances of probe information/data are received. For example, the apparatus 10 may receive a plurality of sequences of instances of probe information/data. Each sequence of instance of probe information/data may be provided by a probe apparatus 20 onboard a vehicle 5. For example, the apparatus 10 may comprise means, such as processor 12, communications interface 16, and/or the like, for receiving a plurality of sequences of instances of probe information/data. In an example embodiment, the probe information/data may comprise at least one of a probe identifier configured to identify the probe apparatus 20, a link identifier configured to identify the digital map link representing the road segment the probe apparatus 20 is travelling along, a location information/data (e.g., comprising a geophysical location of the probe apparatus 20 and determined by a location sensor 30), a travel speed of the probe apparatus 20 and/or the corresponding vehicle 5 travelling along at least a portion of the road segment, a capture time timestamp corresponding to the time the probe information/data was captured, determined, and/or generated, and/or the like. In an example embodiment, the probe information/data is analyzed in time bins or epochs. For example, the instances of probe information/data received during a one minute, five minute, ten minute, and/or the like configurable time period may be binned together and/or analyzed together. In an example embodiment, the time period of the time bins or epochs may be configurable and may be determined such that traffic conditions throughout the time bin or epoch are expected to be generally static. For example, the traffic conditions of the road segment may be approximately constant over a configurable time period equal to the temporal length of the time bin or epoch. In another example embodiment, the time period of the time bins or epochs are predetermined (e.g., two minutes, five minutes, ten minutes, and/or the like).

At block 106, one or more instances of probe information/data provided by a probe apparatus 20 are map matched to determine the road segment that the corresponding vehicle 5 is traveling along. For example, the apparatus 10 may map match one or more instances of probe information/data to determine the road segment that the corresponding vehicle 5 is traveling along. For example, the apparatus 10 may comprise means, such as the processor 12, memory 14, and/or the like, for map matching one or more instances of probe information/data to determine the road segment that the corresponding vehicle 5 is traveling along. For example, a map matching routine may be used to identify the road segment that the vehicle 5 is traveling along. A plurality of instances or probe information/data corresponding to a plurality of vehicles 5 may be map matched to a road segment. For example, a plurality of instances of probe information/data may be map matched to indicate that a plurality of vehicles 5 are traveling across the I-90 Bridge in Seattle.

At block 108, the direction of travel of one or more of the probe apparatuses 20 and/or corresponding vehicles 5 along the identified and/or map matched road segment is determined. For example, the apparatus 10 may determine the direction of travel of one or more probe apparatuses 20 and/or corresponding vehicles 5 along the identified and/or map matched road segment, based on the corresponding sequence of instances of probe information/data. For example, the apparatus may comprise means, such as the processor 12 and/or the like, for determining the direction of travel of one or more probe apparatuses 20 and/or corresponding vehicles 5 along the identified and/or map matched road segment based on the corresponding sequence of instances of probe information/data. For example, it may be determined if the probe apparatus 20 and/or the corresponding vehicle 5 is traveling along the identified and/or map matched road segment in a first direction or a second direction based on the sequence of instances of probe information/data. For example, the location information/data of an instance of probe information/data may be used to identify a position (e.g., latitude and longitude) along a link of a digital map representing a road segment the probe apparatus 20 and/or vehicle 5 is travelling along. The link may be defined by a line in latitude and longitude space.

At block 110, a distance parameter d is determined based for one or more instances of the plurality of instances of probe information/data. In an example embodiment, the distance parameter d is determined based on the location information/data corresponding to the instance of probe information/data. For example, the apparatus 10 may determine a distance parameter d for each instance of the plurality of instances of probe information/data based on the location information/data corresponding to instances of probe information/data. For example, the apparatus 10 my comprise means, such as the processor 12 and/or the like, for determining a distance parameter d for each instance of the plurality of instances of probe information/data. In an example embodiment, the distance parameter d corresponding to an instance of probe information/data may be defined by the distance between (a) the location indicated by the location information/data of the instance of probe information/data and (b) a reference line of a road segment. In an example embodiment, the reference line of the road segment may be travel direction dependent. For example, if it is determined that a vehicle 5 is traveling along Road Segment A in a first direction, a first direction reference line may be used and if it is determined that the vehicle is traveling along Road Segment A in a second direction, a second direction reference line may be used. In an example embodiment, the reference line of a road segment may be a center line of the road segment, a right hand edge of the road segment, a left hand edge of the road segment, and/or another reference line of the road segment. If the road segment is a segment of a divided highway, the reference line may be direction dependent. For example, the portion of a divided highway or other roadway road segment that corresponds to a first direction may have a different reference line than the portion of the divided highway or other roadway segment that corresponds to a second direction. For example, for vehicles determined to be traveling eastbound on I-20, a reference line that corresponds to a center line of the eastbound lanes (e.g., the dedicated eastbound lanes) may be used to determine the distance parameter d.

In an example embodiment, the distance parameter d may indicate a relative position of the location information/data relative to the road segment and/or the reference line. For example, as shown in FIG. 4, the distance parameter d may be the distance between the location 65 corresponding to the location information/data of the instance of probe information/data and the reference line 55. In an example embodiment, the distance parameter d corresponding to an instance of probe information/data may be determined by map matching the location information/data of the instance of probe information/data to the digital map. For example, as noted above, the location information/data may be used to identify a position (e.g., latitude and longitude) along a link of a digital map representing a road segment the probe apparatus 20 and/or vehicle 5 is travelling along. The link may be defined by a line in latitude and longitude space. In an example embodiment, this line may be used as the reference line for the road segment. Thus, in an example embodiment, the distance parameter d may be determined, computed, and/or the like by identifying a position along the link (e.g., a map-matched position) corresponding to the location information/data and then determining the distance from the position along the link (e.g., the map-matched position) to the location indicated by the location information/data. For example, the distance parameter $d_i$ corresponding to instance i of the probe information/data may be determined, computed, and/or the like by $d_i$=Distance (position (map-match), location (location information/data)). In various embodiments, the distance parameter $d_i$ corresponding to instance i of probe information/data may be determined based on the corresponding location information/data using a variety of techniques. Additionally, it should be understood that the terms location and position are used interchangeably herein.

Continuing with FIG. 3, at block 112, one or more instances of the plurality of instances of probe information/data is matched to a lane of the road segment. For example, the relevant vehicle lane pattern may be accessed (e.g., from memory 14 by the processor 12). The relevant vehicle lane pattern may then be used to match an instance of probe information/data to a lane of the road segment based on the corresponding distance parameter d and the representative distance parameters of the lanes and/or the distribution description corresponding to the lanes of the vehicle lane pattern. As noted above, a vehicle lane pattern may be relevant to a particular time of day, day of week, weather condition, and/or the like. In various embodiments, a vehicle lane pattern may be direction dependent. For example, a first vehicle lane pattern may correspond to vehicles traveling along the road segment in a first direction and a second vehicle lane pattern may correspond to vehicles traveling along the road segment in a second direction. If the road segment comprises and/or corresponds to one or more reversible lanes, both the first and second vehicle lane patterns may include the reversible lanes.

For example, an apparatus 10 may match each instance of probe information/data to a lane of the road segment based on the relevant vehicle lane pattern and the distance parameter d corresponding to the instance of probe information/data. For example, an apparatus 10 may comprise means, such as the processor 12 and/or the like, for matching each instance of probe information/data to a lane of the road segment based on the relevant vehicle lane pattern and the distance parameter d corresponding to the instance of probe information/data. For example, if a distance parameter d for a first instance of probe information/data is determined to be 2.3 meters and the vehicle lane pattern for the corresponding road segment has two lanes with the representative distance parameters of 2.0 meters for Lane 1 and 4.5 meters for Lane 2, the first instance of probe information/data may be matched to Lane 1. In an example embodiment, one or more lane probabilities and/or normalized lane probabilities may be determined in addition to and/or in place matching the instance of probe information/data to a lane. In an example embodiment, a lane probability is the probability that a vehicle 5 having the distance parameter d is traveling in a particular lane. In an example embodiment, a normalized lane probability is a probability that has been normalized such that the total probability of the vehicle 5 being in a lane of the road segment, as defined by the vehicle lane pattern, is 100%. For example, the probability that distance parameter d for the first instance of probe information/data corresponds to the corresponding vehicle 5 traveling in Lane 1 may be 85% and the probability that the distance parameter d for the first instance of probe information/data corresponds to the corresponding vehicle 5 traveling in Lane 2 may be 10%. For example, the normalized probability that distance parameter d for the first instance of probe information/data corresponds to the corresponding vehicle 5 traveling in Lane 1 may be 89% and the normalized probability that the distance parameter d for the first instance of probe information/data corresponds to the corresponding vehicle 5 traveling in Lane 2 may be 11%. In an example embodiment, the probability that a distance parameter d corresponds to a particular lane may be determined based on the representative distance parameter for the lane and/or the distribution description for the lane.

At block 114, one or more sequences of lane matched probe information/data may be identified. For example, the apparatus 10 may identify one or more sequences of lane matched probe information/data. For example, the apparatus 10 may comprise means, such as processor 12 and/or the like, for identifying one or more sequences of lane matched probe information/data. In an example embodiment, a sequence of instances of lane matched probe information/data may consist of a plurality of instances of probe information/data that have each been lane matched and that each comprise the same probe identifier. For example a sequence of instances of lane matched probe information/data may be identified based on matching instances of probe information/data comprising the same probe identifier. In an example embodiment, the sequence of instances of lane matched probe information/data may be ordered based on the capture time timestamp associated with each instance of probe information/data.

At block 116, one or more probe trajectories are constructed, built, generated, and/or the like based on the one or more sequences of lane matched probe information/data. For example, a probe trajectory may comprise the matched lane and/or lane probabilities for each instance of probe information/data for a sequence of instances of lane matched probe information/data. In an example embodiment, the probe trajectory may comprise information/data regarding the time/distance interval between consecutive instances of probe information/data provided by the probe apparatus 20 corresponding to the probe trajectory. For example, the apparatus 10 may construct, build, generate, and/or the like one or more probe trajectories. For example, the apparatus 10 may comprise means, such as the processor 12 and/or the like, for constructing, building, generating, and/or the like one or more probe trajectories. For example, for one or more instances of lane matched probe information/data comprising a first probe identifier, it may be determined that at time $t_1$ an instance of probe information/data corresponding to the first probe identifier was matched to Lane 1, at time $t_2$ an instance of probe information/data corresponding to the first probe identifier was matched to Lane 1, and at time $t_3$ an instance of probe information/data corresponding to the first probe identifier was matched to Lane 2. The times $t_1$, $t_2$, and $t_3$ are determined based on the capture time timestamp associated with the corresponding instance of probe information/data. Thus, a probe trajectory corresponding to a particular probe apparatus 20 and/or vehicle 5 may be generated and/or determined based on the corresponding sequence of instances of probe information/data that has been matched to lanes of the road segment. In example embodiments, a probe trajectory may correspond to three or more instances of probe information/data.

At block 118, at least one probe trajectory may be analyzed using lane change probabilities to determine a lane level trajectory. For example, the apparatus 10 may analyze each probe trajectory using lane change probabilities to determine a lane level trajectory corresponding to the probe trajectory, probe identifier, and/or corresponding probe apparatus 20. For example, the apparatus 10 may comprise means, such as the processor 12 and/or the like, for analyzing each probe trajectory using lane change probabilities to determine a lane level trajectory corresponding to the probe trajectory, probe identifier, and/or corresponding probe apparatus 20. For example, the noise within a GNSS reading may cause consecutive instances of probe information/data in a sequence of instances of probe information/data to be matched to different lanes, even if the vehicle 5 travels in the same lane throughout the sequence. For example, a sequence of five instances of probe information/data may lead to a probe trajectory of Lane 1, Lane 2, Lane, 1, Lane 2, Lane 1. However, if the time or distance between the capturing of the instances of probe information/data is short (e.g., a few seconds, a few meters and/or the like), it is unlikely that the vehicle 5 is continuously changing lanes. Therefore, the probe trajectory may be analyzed based at least in part on the probability of a lane change during the time/distance between consecutive instances of probe information/data to determine a lane level trajectory corresponding to the vehicle 5. In an example embodiment, the probability of a lane change during the time/distance between consecutive instances of probe information/data may be determined based on historical probe information/data, apriori information/data, and/or the like. In an example embodiment, the probability of a lane change during a short time/distance interval between consecutive instances of probe information/data may be smaller than the probability of a lane change during a long time/distance interval between consecutive instances of probe information/data. In an example embodiment, the lane change probabilities used to analyze the probe trajectories may be determined, selected, and/or the like, based on the number of lanes of the road segment, the class of the road segment (e.g., highway, arterial, local street, and/or other road type classification), a route being driven by the vehicle 5 that the probe apparatus 20 corresponding to the probe trajectory is onboard, the time of day and/or day of the week, the time/distance interval between consecutive instances of probe information/data, and/or the like. In an example embodiment, a lane level trajectory is the path most likely taken by a probe apparatus 20 and/or vehicle 5 corresponding to the lane level trajectory. For example, in one scenario, for a road segment having four or more lanes, the probability of staying in the same lane in the interval between consecutive instances of probe information/data may be 75%; the probability of changing to a neighboring lane (e.g., one lane to the left or one lane to the right) in the interval between consecutive instances of probe information/data may be 10% for changing lanes to the right and 10% for changing lanes to the left; and the probability of changing to a lane that is not a neighboring lane (e.g., the vehicle 5 must pass through an intermediate lane on the way to the resulting lane) is 5%. The total of the lane change probabilities for a scenario is 100%. An example technique of analyzing a probe trajectory using lane change probabilities is described in more detail elsewhere herein. FIG. 5 illustrates an example lane level trajectory 70. The lane level trajectory 70 comprises a plurality of locations 65 that have been matched to lanes. For example, the color of the dots indicating the locations 65 corresponds to the lane the vehicle 5 was in when the corresponding instance of probe information/data was generated and/or provided as the vehicle was traveling along the road segment 50. Thus, the instances of probe information/data of a sequence instances of probe information/data may be lane level map-matched.

Continuing with FIG. 3, at block 120, the active direction of one or more reversible lanes may be determined. For example, the apparatus 10 may determine the active direction of one or more reversible lanes. For example, the apparatus 10 may comprise means, such as processor 12 and/or the like, for determining the active direction of one or more reversible lanes. For example, based on the lane level trajectories determined for a plurality of probe apparatuses 20 and/or vehicles 5, vehicles traveling in the reversible lane(s) may be identified. For example, if the lane level trajectory for a probe apparatus 20 and/or vehicle 5 indicates that the vehicle is traveling in a reversible lane, the vehicle may be identified as traveling in a reversible lane. Based on the lane level trajectories of a plurality of probe apparatuses 20 and/or vehicles 5, a first number of vehicles traveling in the reversible lane(s) in a first direction may be identified. Similarly, a second number of vehicles traveling in the reversible lane(s) in a second direction may be identified. The active direction of the reversible lane(s) may be determined based on the first number and the second number. For example, as described in more detail elsewhere herein, a confidence metric that the active direction of the reversible lane(s) is the first direction and/or the second direction may be determined. If the confidence metric for the first direction satisfies a threshold requirement, it may be determined that the active direction of the reversible lane(s) is the first direction. If the confidence metric for the second direction satisfies the threshold requirement, it may be determined that the active direction of the reversible lane(s) is the second direction. If the confidence metrics for both the first direction and the second direction do not satisfy the threshold requirement, it may be determined that the reversible lane(s) is closed and/or that there is not enough information/data to make a determination.

After and/or in response to determining an active direction for the reversible lane(s), reversible lane traffic information/data may then be determined based on one or more lane level trajectories. For example, once the active direction of the reversible lane(s) has been determined, the lane level trajectories that correspond to a vehicle traveling in a reversible lane and traveling along the road segment in the active direction of the reversible lane(s) are used to determine reversible lane traffic information/data. For example, reversible lane traffic information/data may be determined based on one or more instances of probe information/data provided by vehicles 5 that were identified as traveling in a reversible lane (e.g., based on the corresponding lane level trajectory) in the active direction of the reversible lane. For example, an average or other representative speed and/or a corresponding standard deviation of speed or other speed distribution description may be determined for the reversible lane(s) of the road segment. In an example embodiment, traffic volume measurement for the reversible lane(s), alerts specific to the reversible lane(s), traffic jam information/data specific to the reversible lane(s), and/or the like may be determined.

At block 122 of FIG. 3, reversible lane traffic information/data is provided. For example, the reversible lane traffic information/data may be provided as part of a reversible lane traffic information/data communication. For example, the apparatus 10 may provide one or more reversible traffic information/data communications to one or more computing entities 35. For example, the apparatus 10 may comprise means, such as processor 12, communications interface 16, and/or the like, for providing one or more reversible lane traffic information/data communications to one or more computing entities 35. In an example embodiment, the reversible lane traffic information/data communication may comprise an active direction and/or status of the reversible lane(s) (e.g., first direction, second direction, closed) and/or at least a portion of the determined reversible lane traffic information/data. In an example embodiment, the reversible lane traffic information/data notification comprises an updated map tile, a traffic information/data map tile layer, and/or the like. For example, a computing entity 35 may be a probe apparatus 20 (e.g., corresponding to a vehicle 5 that is approaching the road segment, expected to travel along the road segment on a current trip or an expected trip, currently travelling along the road segment, and/or the like) or a traffic management apparatus. For example, the computing entity 35 may be a traffic management apparatus that is operated by and/or on behalf of a traffic management agency (e.g., a local department of transportation, city traffic management office, and/or the like). In an example embodiment, a reversible lane traffic information/data communication provided (e.g., transmitted) to a computing entity 35 that is a probe apparatus 20 traveling along the road segment may comprise a lane identifier configured to identify the lane which the corresponding vehicle 5 is currently traveling in (as of the last instance of probe information/data received by the apparatus 10). In example embodiments, the reversible lane traffic information/data communication may comprise computer-executable code and/or reference computer-executable code that, when executed by the computing entity 35 may cause the computing entity 35 to provide one or more reversible lane alerts through a user interface thereof (e.g., a display, audible alert, and/or the like). For example, the location information/data may be used to identify a position (e.g., latitude and longitude) along a link of a digital map representing a road segment the probe apparatus 20 and/or vehicle 5 is travelling along. In an example embodiment, the computing entity 35 may, responsive to receiving the reversible lane traffic information/data communication and/or in response to executing the computer-executable therein and/or referenced thereby, perform one or more navigation tasks and/or lane level navigation tasks based on the reversible lane traffic information/data. For example, one or more route planning computations, determinations, and/or the like may be performed that take into account the reversible lane traffic information/data and provide directions and/or determinations for the route that may include using or not using a reversible lane. For example, a route planning computation, determination, and/or the like may comprise re-calculating a route, determining an updated travel and/or expected arrival time, determining if a reversible lane is available for use by the vehicle (e.g., based on the vehicle's travel direction and the active direction of the reversible lane(s)), determining if it would be advantageous for a vehicle to use a reversible lane, and/or the like.

Embodiments of the present invention allow the use of probe information/data to determine an active direction of one or more reversible lanes and reversible lane traffic information/data. In example embodiments, reversible lane traffic information/data is determined in real time or near real time. For example, example embodiments allow for the determination of a reversible lane active direction and/or reversible lane traffic information/data based on GPS location data despite the GPS location data having a 95% confidence interval that is approximately twice the width of a lane.

As described above, the apparatus 10 is configured to determine the lane traveled by a vehicle 5 and/or the corresponding probe apparatus 20. However, in an example embodiment, a probe apparatus 20 may use a technique similar to that described above to determine the lane currently being traveled in by the probe apparatus 20 and/or the corresponding vehicle 5. For example, a map and/or a tile of a map stored by the probe apparatus 20 (e.g., in memory 24) may comprise a vehicle lane pattern for one or more road segments within the geographical area represented by the map and/or tile of the map. In an example embodiment, the probe apparatus 20 may store (e.g., in memory 24) a vehicle lane pattern for one or more road segments independent of a map and/or map tile and/or the probe apparatus 20 may access and/or receive a vehicle lane pattern provided by the apparatus 10. Thus, as should be understood based on the above, the probe apparatus 20 may use the vehicle lane pattern to determine the lane that the probe apparatus 20 and/or the corresponding vehicle 5 is currently traveling in. In such an embodiment, the probe information/data provided by the probe apparatus 20 may include a lane determination indicating the lane the vehicle 5 is currently traveling in.

The process may then return to block 104 such that the active direction of the reversible lane(s) and reversible lane traffic information/data for the next epoch may be determined and/or provided.

Analyzing A Probe Trajectory

A non-limiting example technique of analyzing a probe trajectory using lane change probabilities to determine a lane level trajectory, in accordance with an example embodiment, will now be described with respect to FIG. 6. FIG. 6 is a flowchart providing some processes and procedures for analyzing a probe trajectory using lane change probabilities to determine a lane level trajectory and/or reversible lane traffic information/data, in accordance with an example embodiment.

Starting at block 202, a lane trajectory hidden Markov model (HMM) is built based on the probe trajectory. For example, the apparatus 10 may build a lane trajectory HMM based on the probe trajectory. For example, the apparatus 10 may comprise means, such as the processor 12 and/or the like, for building a lane trajectory HMM based on the probe trajectory. In general, a lane trajectory HMM is a statistical Markov model in which the system being modeled is assumed to be a Markov chain with unobserved (e.g., hidden) states. In particular, the possible states of the lane trajectory HMM correspond to the lanes of the road segment as described by the vehicle lane pattern. The state probabilities correspond to the probability that a lane exists. Given the vehicle lane pattern and/or other known information/data corresponding to the road segment, the probability that a particular lane exists on the road segment is 100%. The possible observations of the lane trajectory HMM correspond to the data parameters, matched lanes, and/or lane probabilities of the probe trajectory. The state transition probabilities of the lane trajectory HMM correspond to the lane change probabilities. As noted above the lane change probabilities may be based on apriori information/data, historical probe information/data, and/or the like. The output and/or emission probabilities of the lane trajectory HMM correspond to the probability of the vehicle traveling a particular lane at the time each instance of the sequence of instances of probe information/data was captured and/or provided and will provide the lane level trajectory. For example, FIG. 7 shows an example trellis diagram 80 illustrating the lane trajectory HMM for a road segment having k lanes and probe trajectory corresponding to m instances of probe information/data.

Returning to FIG. 6, at block 204, the lane level trajectory corresponding to the input probe trajectory is obtained by determining and/or solving for the Viterbi-path for the lane trajectory HMM. For example, the apparatus 10 may obtain the lane level trajectory corresponding to the probe trajectory by determining and/or solving for the Viterbi-path of the lane trajectory HMM. For example, the apparatus 10 may comprise means, such as the processor 12 and/or the like, for obtaining the lane level trajectory corresponding to the probe trajectory by determining and/or solving for the Viterbi-path of the HMM. For example, the Viterbi algorithm may be used to determine and/or solve for the Viterbi-path of the lane trajectory MM. For example, $V_{P_i,Ln}=\max_{x\in X}(P(d_i|Ln)\cdot a_{x,Ln}\cdot V_{P_{i-1},x})$, wherein $V_{Pi,\ Ln}$ is the value (or the optimal probability) of a vehicle being in a particular lane when the corresponding probe apparatus 20 generated and/or provided probe information/data instance i, x is a lane in the set of lanes X (wherein the set of lanes X is defined by the vehicle lane pattern), $P(d_i|Ln)$ is the probability that an observation of distance parameter d at probe information/data instance i of the probe trajectory is observed when the corresponding vehicle 5 is in lane Ln, and $a_{x,Ln}$ is the lane change probability from lane x to lane Ln. For the first point in the probe trajectory, $V_{P_1,k}=(P(d_1|k)\cdot\pi_k)$ where $\pi_k$ is the initial probabilities of being in lane k (e.g., the general probability that a vehicle may be in a particular lane, the (normalized) lane probabilities for the first instance of probe information/data of the sequence, and/or the like). In an example embodiment, $\pi_k$ may be determined based on historical probe information/data, lane level volume information/data from a previous determination of lane level traffic information/data (e.g., the immediately previously determined lane level traffic information/data), the lane probabilities corresponding to the sequence of instances of probe information/data corresponding to the probe trajectory, and/or the like. Back-tracing the Viterbi-path, the sequence of states across the link corresponding to the road segment can be obtained and the final output would be a sequence of lanes corresponding to the path traveled by the vehicle 5 for which the corresponding probe trajectory is being analyzed. In an example embodiment, the emission probabilities $P(d_i|Ln)$ can be computed using the relevant vehicle lane pattern (e.g., stored in memory 14) and the matched lane and/or lane probabilities determined at block 112. For example, the representative distance parameter (e.g., average distance parameter) and distribution description (e.g., standard deviation) of the relevant vehicle lane pattern may be used to compute the emission probabilities $P(d_i|Ln)$. For example, assuming that the probes are distributed following a Gaussian distribution, we can compute the emission probabilities $P(d_i|Ln)$ using the Gaussian density function:

$$P(d_i \mid \mu_{Ln}, \sigma_{Ln}^2) = \frac{1}{\sqrt{2\sigma_{Ln}^2\pi}} e^{-\frac{(d_i-\mu_{Ln})^2}{2\sigma_{Ln}^2}},$$

wherein $\mu_{Ln}$ is the representative distance parameter for lane Ln and $\sigma_{Ln}$ is the distribution description of the distance parameter for lane Ln, as provided by the vehicle lane pattern. As noted above, the lane change probability $a_{x,Ln}$ is designed account for the assumption that vehicles usually stay on the same lane and that lane changes are rare compared to the number of instances of probe information/data. Thus, the Viterbi-path for a lane trajectory HMM built on a probe trajectory may be obtained, wherein the Viterbi-path is a likely sequence of lanes for each instance of probe information/data in the sequence of instances of probe information/data. In an example embodiment, the lane level trajectory is defined based on the Viterbi-path corresponding to the probe trajectory. Hence the probe trajectory is map-matched at lane level to provide a lane level trajectory. In an example embodiment, a plurality of lane level trajectories may be determined, wherein each lane level trajectory is determined based on a probe trajectory.

At block 206, a reversible lane active direction and/or reversible lane traffic information/data is determined based on a plurality of lane level trajectories. For example, based on the lane level trajectory, each instance of probe information/data may be assigned a lane. The plurality of instances probe information/data may then be segmented based on the lane assigned to each instance of probe information/data. For example, the instances of the plurality of instances of probe information/data traveling along the road segment in a first direction and assigned to a reversible lane may be partitioned into a first segment, the instances of the plurality of instances of probe information/data traveling along the road segment in a second direction and assigned to a reversible lane may be partitioned into a second segment, and/or the like. Based on the number of vehicles for which the corresponding probe information/data is assigned to the first segment (e.g., a first number) and the number of vehicles for which the corresponding probe information/data is assigned to the second segment (e.g., a second number), an active direction of the reversible lane(s) may be determined. Once the active direction is determined, the probe information/data assigned to the segment corresponding to the active direction may be used to determine reversible lane traffic information/data. For example, a representative speed (e.g., average speed), a speed distribution description (e.g., standard distribution of speeds), a measure of the volume of traffic, and/or the like corresponding to the reversible lane(s) may be determined.

Determining an Active Direction of a Reversible Lane

As described above, first number and a second number may be determined. The first number is the number of vehicles determined to be traveling in a reversible lane corresponding to a road segment and that are traveling in a first direction. The second number is the number of vehicles determined to be traveling in a reversible lane corresponding to a road segment and that are traveling in a second direction. The first number and second number may be used to determine the active direction of the reversible lane(s) corresponding to the road segment. FIG. 8 is a flowchart providing some processes and procedures for determining an active direction of one or more reversible lanes, in accordance with an example embodiment.

Starting at block 302, the first number and the second number are determined. For example, the number of lane level trajectories matched to a reversible lane in each travel direction is determined. For example, the apparatus 10 may determine a first number of lane level trajectories matched to a reversible lane and traveling along the road segment in a first direction and the apparatus 10 may determine a second number of lane level trajectories matched to a reversible lane and traveling along the road segment in a second direction. For example, the apparatus 10 may comprise means, such as a processor 12 and/or the like, for determining a first number of lane level trajectories matched to a reversible lane and traveling along the road segment in a first direction and determining a second number of lane level trajectories matched to a reversible lane and traveling along the road segment in a second direction.

At block 304, an active direction hidden Markov model (HMM) may be built based on the first number and the second number. For example, the apparatus 10 may build an active direction HMM based on the first number and the second number. For example, the apparatus 10 may comprise means, such as the processor 12 and/or the like, for building an active direction HMM based on the first number and the second number. In an example embodiment, the active direction HMM may be built on the first number and the second number for one or more epochs and/or time bins. For example, the first number and second number for, for example, three, four, or more adjacent epochs or time bins (e.g., the current epoch and the three previous epochs) may be used to generate the active direction HMM. In an example embodiment, the active direction (e.g., first direction, second direction, or closed) determined for one or more previous epochs may be used in place of and/or in addition to the first and second numbers for one or more previous epochs to build the active direction HMM.

In general, an active direction HMM is a statistical Markov model in which the system being modeled is assumed to be a Markov chain with unobserved (e.g., hidden) states. In particular, the possible states of the lane trajectory HMM correspond to the possible active directions of the reversible lane(s) (e.g., first direction, second direction, closed). The possible observations of the active direction HMM correspond to the first number and the second number. The state transition probabilities of the lane trajectory HMM correspond to the probabilities of the active direction of the active direction HMM changing states (e.g., the active direction switching from the first direction to the second direction, from the first direction to closed, and/or the like). As noted above the state transition probabilities may be based on apriori information/data, historical reversible lane information/data, a published and/or provided reversible lane schedule (e.g., provided by a traffic management agency), the time of day, and/or the like. The output and/or emission probabilities of the active direction HMM correspond to the probability of the reversible lane being in a particular state or having a particular active direction in a particular epoch. For example, FIG. 9 provides a Markov graph 90 of an example active direction HMM. The Markov graph 90 includes a first direction state 92, a closed state 94, and a second direction state 96. The Markov graph 90 also indicates example transition probabilities between each of the first direction state 92, closed state 94, and second direction state 96, according to an example embodiment. FIG. 10 shows an example trellis diagram 98 illustrating the active direction HMM for a road segment having a reversible lane that has a set of predefined states (a first direction state, a second direction state, and a closed state) corresponding to x epochs of probe information/data.

Returning to FIG. 8, at block 306, the probability of each of the possible active directions (e.g., first direction, second direction, closed) and/or the possible active direction having the highest probability is determined. For example, the probability of each of the possible active directions and/or the possible active direction having the highest probability may be determined by determining and/or solving for the Viterbi-path for the active direction HMM. For example, the apparatus 10 may obtain the probability of each of the possible active directions and/or the possible active direction having the highest probability by determining and/or solving for the Viterbi-path of the lane trajectory HMM. For example, the apparatus 10 may comprise means, such as the processor 12 and/or the like, for obtaining the probability of each of the possible active directions and/or the possible active direction having the highest probability by determining and/or solving for the Viterbi-path of the HMM. For example, the Viterbi algorithm may be used to determine and/or solve for the Viterbi-path of the lane trajectory HMM. For example, $V_{P_i,y}=\max_{x\in X}(P\ (r_i|y)\cdot a_{x,y}\cdot V_{P_{i-1},x})$, wherein $V_{Pi,\ y}$ is the value (or the optimal probability) of the reversible lane(s) being in a state y corresponding to a particular possible active direction (e.g., first direction, second direction, closed) during a particular epoch i, x is a possible active direction of the set of predefined possible active directions X (e.g., X consists of first direction, second direction, and closed), P $(r_i|y)$ is the probability that an observation of a first number, a second number, and/or a ratio $r_i$ of the first number and the second number at a particular epoch i of the is observed when the reversible lane corresponding to a particular possible active direction, and $a_{x,y}$ is the state change probability from active direction x to active direction y. For the first point in the probe trajectory, $V_{P_1,k}=(P(r_1|k)\cdot\pi_k)$ where $\pi_k$ is the initial probabilities of the active direction being a particular active direction. In an example embodiment, $\pi_k$ may be determined based on historical reversible lane traffic information/data, published and/or other schedules provided by a traffic management agency, and/or the like. Back-tracing the Viterbi-path, the sequence of active directions of the reversible lane(s) over multiple epochs can be obtained and the final output would be a sequence of active directions of the reversible lane(s) over a period of time. In an example embodiment, the state change probabilities $P(r_i|y)$ can be computed based on apriori information/data, based on a time of day, based on a published and/or other schedule provided by a traffic management agency, and/or the like. Thus, the Viterbi-path for an active direction HMM built on a series of first number, second numbers and/or a ratio of first number and second numbers over a plurality of epochs, wherein the Viterbi-path is a likely sequence of active directions for each epoch. In an example embodiment, the current active direction is identified and/or determined based on the determined Viterbi-path.

At block 308, a confidence metric is determined. For example, a confidence metric may be determined to determine the likelihood that determined active direction is the actual active direction. For example, the apparatus 10 may determine a confidence metric corresponding to the determined active direction. For example, the apparatus 10 may comprise means, such as processor 12 and/or the like, for determining a confidence metric corresponding to the determined active direction. In an example embodiment, the confidence metric may be determined based on the ratio of the first number to the second number for one or more epochs, the active direction of one or more previous epochs, a published and/or provided schedule of directions for the reversible lane(s), and/or the like.

For example, in one embodiment, the confidence metric is equal to the number of probe apparatuses 20 and/or vehicles 5 identified as being on the reversible lane(s) and traveling in a direction that matches the determined active direction for the corresponding epoch for each epoch of a considered set of epochs divided by the total number of probe apparatuses and/or vehicles 5 identified as being on the reversible lane(s) for the epochs of the considered set of epochs. In an example embodiment, the considered set of epochs may be a predetermined or configurable number of consecutive epochs (e.g., the three epochs immediately preceding the current epoch). In an example embodiment, the considered set of epochs may be determined based on the day of the week, time of day, and/or the like. For example, if the time is 4:00 pm on Tuesday, the considered set of epochs may comprise epochs occurring between 3:30 and 4:30 pm last Tuesday, the epochs occurring between 3:30 and 4:30 pm on the previous week day (e.g., Monday), the epochs occurring between 3:30 and 4:00 pm on the current day, a combination thereof, and/or the like. For example, in one embodiment, the confidence metric is the ratio of the number of probe apparatuses 20 and/or vehicles 5 identified as being on the reversible lane(s) and traveling in the determined active direction for the current epoch and one or more (e.g., three) epochs immediately preceding the current epoch to the total number of probe apparatuses 20 and/or vehicles 5 identified as being on the reversible lane(s) over the same time period. For example, $$\text{confidence} = \frac{\text{probe apparatuses on reversible in active direction in last 4 epochs}}{\text{total number of probe apparatuses on reversible in last 4 epochs}}. \quad (1)$$

In one example embodiment, the confidence metric may be determined by taking the ratio of the number of epochs of a considered set of epochs for which the determined active direction is the same as the current determined active direction to the total number of epochs in the considered set of epochs. For example, $$\text{confidence} = \frac{\text{number of epochs predicting the current active direction}}{\text{total number of epochs}}. \quad (2)$$

In one example embodiment, the confidence metric may be computed by taking the ratio of the number of probe apparatuses 20 and/or vehicles 5 identified as being on the reversible lane(s) and traveling in the active direction during epochs of the considered set of epochs wherein the determined active direction is the same as the current determined active direction to the total number of probe apparatuses 20 and/or vehicles 5 identified as being on the reversible lane(s) during the considered set of epochs. For example, $$\text{confidence} = \frac{\Sigma_{\text{epochs predicting current active direction}} \text{probes on reversible in active dir}}{\Sigma_{\text{all epochs}} \text{probes on reversible}}. \quad (3)$$

For example, Table 1 provides the determined active direction, number of probes on the reversible lane(s) and traveling in a first direction, and the number of probes on the reversible lane(s) and traveling in a second direction.

TABLE 1

| Epoch | Determined Active Direction | First Direction Probe Apparatuses | Second Direction Probe Apparatuses |
|---|---|---|---|
| 1 | First Direction | 20 | 3 |
| 2 | Closed | 0 | 1 |
| 3 | Second Direction | 2 | 15 |
| 4 (Current) | Second Direction | 3 | 20 |

In the current epoch the apparatus 10 has determined that the active direction is the second direction. If the considered set of epochs is the current epoch and the three immediately preceding epochs described in Table 1, Table 2 provides examples of computing three different confidence metrics as examples of the confidence metrics described above.

TABLE 2

| Metric | Confidence |
|---|---|
| (1) | (3 + 1 + 15 + 20)/(23 + 1 + 17 + 23) = 39/64 = 61% |
| (2) | 2/4 = 50% |
| (3) | (15 + 20)/(23 + 1 + 17 + 23) = 35/64 = 55% |

As should be understood, in various embodiments, a variety of confidence metrics may be computed, generated, determined, and/or the like to determine a confidence level of the determined active direction.

Continuing with FIG. 8, at block 310, it is determined if the confidence metric satisfies a predetermined threshold requirement. For example, it may be determined if the confidence metric indicates that the active direction of the reversible lane(s) has been determined to with a confidence greater than a threshold confidence level. For example, the apparatus 10 may determine whether the confidence metric satisfies a predetermined threshold requirement. For example, the apparatus 10 may comprise means, such as the processor 12 and/or the like, for determining whether the confidence metric satisfies a predetermined threshold requirement.

If, at block 310 it is determined that the confidence metric satisfies the predetermined threshold requirement, the process continues to block 312. At block 312, the active direction is provided. For example, the active direction may be provided to one or more computing entities 35 (e.g., as part of a reversible lane traffic information/data communication and/or the like); used to determine, generate, and/or compute reversible lane traffic information/data, and/or the like. For example, the apparatus 10 may use the determined active direction to determine, generate and/or compute reversible lane traffic information/data and/or provide the active direction to one or more computing entities 35. For example, the apparatus 10 may comprise means, such as the processor 12, communication interface 16, and/or the like, for determining, generating, and/or computing reversible lane traffic information/data based on the determined active direction and/or providing the active direction to one or more computing entities 35.

If, at block 310, it is determined that the confidence metric does not satisfy the predetermined threshold requirement, the process continues to block 314. At block 314, it may be determined that the current active direction of the reversible lane(s) cannot be determined. For example, if the volume of probe apparatuses and/or vehicles 5 identified as traveling on the reversible lane(s), the current active direction of the reversible lane(s) may not be able to be determined. For example, if the reversible lane(s) is closed, the number of probe apparatuses 20 and/or vehicles 5 identified as traveling along the reversible lane(s) may be very small and therefore it may be determined that the reversible lane(s) is closed. For example, the apparatus 10 may, in response to the confidence metric not satisfying the predetermined threshold requirement, determine that the active direction of the reversible lane(s) cannot be determined and/or that the reversible lane(s) is closed. For example, the apparatus 10 may comprise means, such as the processor 12 and/or the like, for determining, in response to the confidence metric not satisfying the predetermined threshold requirement, that the active direction of the reversible lane(s) cannot be determined and/or that the reversible lane(s) is closed.

In response to determining that the active direction of the reversible lane(s) cannot be currently determined and/or that the reversible lane is closed, a reversible lane traffic information/data communication indicating that the active direction of the reversible lane(s) cannot be currently determined and/or that the reversible lane is closed may be provided to one or more computing entities 35, at block 316. For example, the apparatus 10 may provide a reversible lane traffic information/data communication indicating that the active direction of the reversible lane(s) cannot currently be determined and/or that the reversible lane(s) is closed. For example, the apparatus 10 may comprise means, such as the processor 12, communication interface 16, and/or the like, for providing a reversible lane traffic information/data communication indicating that the active direction of the reversible lane(s) cannot currently be determined and/or that the reversible lane(s) is closed to one or more computing entities 35. In an example embodiment, the reversible lane traffic information/data communication may not comprise additional reversible lane traffic information beyond the indication of the active direction of the reversible lane(s) being unknown and/or closed.

III. Example Apparatus

The probe apparatus 20, computing entity 35, and/or apparatus 10 of an example embodiment may be embodied by or associated with a variety of computing devices including, for example, a navigation system including an in-vehicle navigation system, a vehicle control system, a personal navigation device (PND) or a portable navigation device, an advanced driver assistance system (ADAS), a global navigation satellite system (GNSS), a cellular telephone, a mobile phone, a personal digital assistant (PDA), a watch, a camera, a computer, and/or other device that can perform navigation-related functions, such as digital routing and map display. Additionally or alternatively, the probe apparatus 20, computing entity 35, and/or apparatus 10 may be embodied in other types of computing devices, such as a server, a personal computer, a computer workstation, a laptop computer, a plurality of networked computing devices or the like, that are configured to update one or more map tiles, analyze probe points for route planning or other purposes. In this regard, FIG. 2A depicts an apparatus 10 and FIG. 2B depicts a probe apparatus 20 of an example embodiment that may be embodied by various computing devices including those identified above. As shown, the apparatus 10 of an example embodiment may include, may be associated with or may otherwise be in communication with a processor 12 and a memory device 14 and optionally a communication interface 16 and/or a user interface 18. Similarly, a probe apparatus 20 of an example embodiment may include, may be associated with, or may otherwise be in communication with a processor 22, and a memory device 24, and optionally a communication interface 26, a user interface 28, one or more sensors 30 (e.g., a location sensor such as a GNSS sensor, IMU sensors, and/or the like; camera(s); 2D and/or 3D LiDAR(s); long, medium, and/or short range RADAR; ultrasonic sensors; electromagnetic sensors; (near-)IR cameras, 3D cameras, 360° cameras; and/or other sensors that enable the probe apparatus to determine one or more features of the corresponding vehicle's 5 surroundings), and/or other components configured to perform various operations, procedures, functions, or the like described herein. In example embodiments, a computing entity 35 may, similar to the apparatus 10 and/or probe apparatus 20, comprise a processor, memory device, communication interface, user interface, and/or one or more additional components configured to perform various operations, procedures, functions, or the like described herein. In an example embodiment, a computing entity may comprise one or more sensors similar to the one or more sensors 30.

In some embodiments, the processor 12, 22 (and/or co-processors or any other processing circuitry assisting or otherwise associated with the processor) may be in communication with the memory device 14, 24 via a bus for passing information among components of the apparatus. The memory device may be non-transitory and may include, for example, one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As described above, the apparatus 10, computing entity 35, and/or probe apparatus 20 may be embodied by a computing device. However, in some embodiments, the apparatus may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 12, 22 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 12, 22 may be configured to execute instructions stored in the memory device 14, 24 or otherwise accessible to the processor. For example, the processor 22 may be configured to execute computer-executed instructions embedded within a link record of a map tile. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (e.g., a pass-through display or a mobile terminal) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

In some embodiments, the apparatus 10, computing entity 35, and/or probe apparatus 20 may include a user interface 18, 28 that may, in turn, be in communication with the processor 12, 22 to provide output to the user, such as a proposed route, and, in some embodiments, to receive an indication of a user input. As such, the user interface may include a display and, in some embodiments, may also include a keyboard, a mouse, a joystick, a touch screen, touch areas, soft keys, a microphone, a speaker, or other input/output mechanisms. Alternatively or additionally, the processor may comprise user interface circuitry configured to control at least some functions of one or more user interface elements such as a display and, in some embodiments, a speaker, ringer, microphone and/or the like. The processor and/or user interface circuitry comprising the processor may be configured to control one or more functions of one or more user interface elements through computer program instructions (e.g., software and/or firmware) stored on a memory accessible to the processor (e.g., memory device 14, 24, and/or the like).

The apparatus 10, computing entity 35, and/or the probe apparatus 20 may optionally include a communication interface 16, 26. The communication interface may be any means such as a device or circuitry embodied in either hardware or a combination of hardware and software that is configured to receive and/or transmit data from/to a network and/or any other device or module in communication with the apparatus. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms.

In addition to embodying the apparatus 10, computing entity 35, and/or probe apparatus 20 of an example embodiment, a navigation system may also include or have access to a geographic database that includes a variety of data (e.g., map information/data) utilized in constructing a route or navigation path, determining the time to traverse the route or navigation path, matching a geolocation (e.g., a GNSS determined location) to a point on a map and/or link, and/or the like. For example, a geographic database may include node data records (e.g., including anchor node data records comprising junction identifiers), road segment or link data records, point of interest (POI) data records and other data records. More, fewer or different data records can be provided. In one embodiment, the other data records include cartographic ("carto") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GNSS data associations (such as using known or future map matching or geo-coding techniques), for example. In an example embodiment, the data records (e.g., node data records, link data records, POI data records, and/or other data records) may comprise computer-executable instructions, a reference to a function repository that comprises computer-executable instructions, one or more coefficients and/or parameters to be used in accordance with an algorithm for performing the analysis, one or more response criteria for providing a response indicating a result of the analysis, and/or the like. In at least some example embodiments, the probe apparatus 20 and/or computing entity 35 may be configured to execute computer-executable instructions provided by and/or referred to by a data record. In an example embodiment, the apparatus 10 may be configured to modify, update, and/or the like one or more data records of the geographic database.

In an example embodiment, the road segment data records are links or segments, e.g., maneuvers of a maneuver graph, representing roads, streets, or paths, as can be used in the calculated route or recorded route information for determination of one or more personalized routes. The node data records are end points corresponding to the respective links or segments of the road segment data records. The road link data records and the node data records represent a road network, such as used by vehicles, cars, and/or other entities. Alternatively, the geographic database can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, vehicle lane patterns, and other navigation related attributes, as well as POIs, such as gasoline stations, hotels, restaurants, museums, stadiums, offices, automobile dealerships, auto repair shops, buildings, stores, parks, etc. The geographic database can include data about the POIs and their respective locations in the POI data records. The geographic database can also include data about places, such as cities, towns, or other communities, and other geographic features, such as bodies of water, mountain ranges, etc. Such place or feature data can be part of the POI data or can be associated with POIs or POI data records (such as a data point used for displaying or representing a position of a city). In addition, the geographic database can include and/or be associated with event data (e.g., traffic incidents, constructions, scheduled events, unscheduled events, etc.) associated with the POI data records or other records of the geographic database.

The geographic database can be maintained by the content provider (e.g., a map developer) in association with the services platform. By way of example, the map developer can collect geographic data to generate and enhance the geographic database. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used. In an example embodiment, the geographic database may be updated based on information/data provided by one or more probe apparatuses.

The geographic database can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions. The navigation-related functions can correspond to vehicle navigation or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases. Regardless of the manner in which the databases are compiled and maintained, a navigation system that embodies an apparatus 10, computing entity 35, and/or probe apparatus 20 in accordance with an example embodiment may determine the time to traverse a route that includes one or more turns at respective intersections more accurately.

IV. Apparatus, Methods, and Computer Program Products

As described above, FIGS. 3, 6, and 8 illustrate flowcharts of apparatuses 10, methods, and computer program products according to an example embodiment of the invention. It will be understood that each block of the flowcharts, and combinations of blocks in the flowcharts, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by the memory device 14, 24 of an apparatus employing an embodiment of the present invention and executed by the processor 12, 22 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method comprising:

receiving a plurality of sequences of instances of probe data by an apparatus comprising a processor and a communication interface, each sequence of instances of probe data being captured and provided by a probe apparatus of a plurality of probe apparatuses, the probe apparatus comprising a plurality of sensors and being onboard a vehicle, wherein (a) an instance of probe data (i) comprises location information indicating a location of the corresponding probe apparatus, the location information determined by a sensor onboard the vehicle and (ii) corresponds to a capture time at which the location information was captured and (b) a sequence of instances of probe data are ordered by the capture time corresponding to each instance of probe data;

determining, by the apparatus, a travel direction of each probe apparatus of the plurality of probe apparatuses based on the corresponding sequence of instances of probe data;

matching, by the apparatus, each probe apparatus to a lane of a road segment based on the determined travel direction and a predetermined vehicle lane pattern, the vehicle lane pattern comprising at least one reversible lane;

identifying, by the apparatus, a first number of probe apparatuses and a second number of probe apparatuses, wherein (a) the first number of probe apparatuses were matched to the reversible lane and have a travel direction of a first direction and (b) the second number of probe apparatuses were matched to the reversible lane and have a travel direction of a second direction;

based on the first number and the second number, determining, by the apparatus, an active direction for the at least one reversible lane, wherein determining the active direction for the at least one reversible lane comprises:

generating a hidden Markov model based on the first number and the second number for one or more epochs, wherein an epoch is a time window of a predetermined length, and determining a probability that the active direction of the at least one reversible lane is one of each of a predefined set of states, the predefined set of states comprising: a first direction, a second direction, and closed; and providing the active direction such that a computing entity receives the active direction, wherein the computing entity is configured to perform a route planning determination based at least in part on the active direction.

2. The method according to claim 1, further comprising determining reversible lane traffic data corresponding to traffic conditions currently being experienced on the at least one reversible lane based on the sequences of instances of probe data corresponding to the probe apparatuses matched to the at least one reversible lane in the active direction.

3. The method according to claim 2, further comprising providing a reversible lane traffic data communication comprising at least a portion of the reversible lane traffic data to a computing entity, wherein, when the traffic data communication is processed by the computing entity, the traffic data communication causes the computing entity to (a) perform one or more route planning determinations, (b) provide an alert corresponding to the traffic conditions, or (c) both.

4. The method according to claim 1, further comprising determining a confidence metric for the active direction based on the number of probe apparatuses matched to the at least one reversible lane for each direction for one or more epochs, wherein an epoch is a time window of a predetermined length.

5. The method according to claim 4, wherein the active direction is determined in response to determining that the confidence metric satisfies a threshold requirement.

6. The method according to claim 1, wherein determining the active direction comprises selecting a state of the predefined set of states having the highest probability.

7. The method according to claim 6, wherein a confidence metric is determined for the active direction based at least in part on at least one previous active direction corresponding to at least one of the one or more epochs.

8. The method according to claim 1, wherein one or more transition probabilities of the hidden Markov model are time dependent.

9. The method according to claim 1, wherein one or more transition probabilities of the hidden Markov model for at least one of the one or more epochs is determined based on a schedule for the at least one reversible lane.

10. An apparatus comprising at least one processor, and at least one memory storing computer program code, with the at least one memory and the computer program code configured to, with the processor, cause the apparatus to at least:

receive a plurality of sequences of instances of probe data, each sequence of instances of probe data being captured and provided by a probe apparatus of a plurality of probe apparatuses, the probe apparatus comprising a plurality of sensors and being onboard a vehicle, wherein (a) an instance of probe data (i) comprises location information indicating a location of the corresponding probe apparatus and (ii) corresponds to a capture time at which the location information was captured and (b) a sequence of instances of probe data are ordered by the capture time corresponding to each instance of probe data;

determine a travel direction of each probe apparatus of the plurality of probe apparatuses based on the corresponding sequence of instances of probe data;

match each probe apparatus to a lane of a road segment based on the determined travel direction and a predetermined vehicle lane pattern, the vehicle lane pattern comprising at least one reversible lane;

identify a first number of probe apparatuses and a second number of probe apparatuses, wherein (a) the first number of probe apparatuses were matched to the reversible lane and have a travel direction of a first direction and (b) the second number of probe apparatuses were matched to the reversible lane and have a travel direction of a second direction; and based on the first number and the second number, determine an active direction for the at least one reversible lane, wherein determining the active direction for the at least one reversible lane comprises:

generating a hidden Markov model based on the first number and the second number for one or more epochs, wherein an epoch is a time window of a predetermined length, and determining a probability that the active direction of the at least one reversible lane is one of each of a predefined set of states, the predefined set of states comprising: a first direction, a second direction, and closed; and provide the active direction such that a computing entity receives the active direction, wherein the computing entity is configured to perform a route planning determination based at least in part on the active direction.

11. The apparatus according to claim 10, wherein the at least one memory and the computer program code are further configured to, with the processor, cause the apparatus to at least determine reversible lane traffic data corresponding to traffic conditions currently being experienced on the at least one reversible lane based on the sequences of instances of probe data corresponding to the probe apparatuses matched to the at least one reversible lane in the active direction.

12. The apparatus according to claim 11, wherein the at least one memory and the computer program code are further configured to, with the processor, cause the apparatus to at least provide a reversible lane traffic data communication comprising at least a portion of the reversible lane traffic data to a computing entity, wherein, when the traffic data communication is processed by the computing entity, the traffic data communication causes the computing entity to (a) perform one or more route planning determinations, (b) provide an alert corresponding to the traffic conditions, or (c) both.

13. The apparatus according to claim 10, wherein the at least one memory and the computer program code are further configured to, with the processor, cause the apparatus to at least determine a confidence metric for the active direction based on the number of probe apparatuses matched to the at least one reversible lane for each direction for one or more epochs, wherein an epoch is a time window of a predetermined length, wherein the active direction is determined in response to determining that the confidence metric satisfies a threshold requirement.

14. The apparatus according to claim 10, wherein determining the active direction comprises selecting a state of the predefined set of states having the highest probability.

15. The apparatus according to claim 14, wherein a confidence metric is determined for the active direction based at least in part on at least one previous active direction corresponding to at least one of the one or more epochs.

16. The apparatus according to claim 10, wherein one or more transition probabilities of the hidden Markov model are time dependent.

17. The apparatus according to claim 10, wherein one or more transition probabilities of the hidden Markov model for at least one of the one or more epochs is determined based on a schedule for the at least one reversible lane.

18. A computer program product comprising at least one non-transitory computer-readable storage medium having computer-executable program code instructions stored therein with the computer-executable program code instructions comprising program code instructions configured to:

receive a plurality of sequences of instances of probe data, each sequence of instances of probe data being captured and provided by a probe apparatus of a plurality of probe apparatuses, the probe apparatus comprising a plurality of sensors and being onboard a vehicle, wherein (a) an instance of probe data (i) comprises location information indicating a location of the corresponding probe apparatus and (ii) corresponds to a capture time at which the location information was captured and (b) a sequence of instances of probe data are ordered by the capture time corresponding to each instance of probe data;

determine a travel direction of each probe apparatus of the plurality of probe apparatuses based on the corresponding sequence of instances of probe data;

match each probe apparatus to a lane of a road segment based on the determined travel direction and a predetermined vehicle lane pattern, the vehicle lane pattern comprising at least one reversible lane;

identify a first number of probe apparatuses and a second number of probe apparatuses, wherein (a) the first number of probe apparatuses were matched to the reversible lane and have a travel direction of a first direction and (b) the second number of probe apparatuses were matched to the reversible lane and have a travel direction of a second direction; and based on the first number and the second number, determine an active direction for the at least one reversible lane, wherein determining the active direction for the at least one reversible lane comprises:

generating a hidden Markov model based on the first number and the second number for one or more epochs, wherein an epoch is a time window of a predetermined length, and determining a probability that the active direction of the at least one reversible lane is one of each of a predefined set of states, the predefined set of states comprising: a first direction, a second direction, and closed; and provide the active direction such that a computing entity receives the active direction, wherein the computing entity is configured to perform a route planning determination based at least in part on the active direction.

* * * * *